US007827948B2

(12) United States Patent
Kokubo et al.

(10) Patent No.: US 7,827,948 B2
(45) Date of Patent: Nov. 9, 2010

(54) VARIABLE VALVE TIMING CONTROL APPARATUS OF INTERNAL COMBUSTION ENGINE

(75) Inventors: Naoki Kokubo, Hiratsuka (JP); Yoshiyuki Kobayashi, Atsugi (JP); Masahiko Watanabe, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 274 days.

(21) Appl. No.: 12/187,738

(22) Filed: Aug. 7, 2008

(65) Prior Publication Data

US 2009/0090322 A1 Apr. 9, 2009

(30) Foreign Application Priority Data

Oct. 5, 2007 (JP) ..... 2007-261582

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 7,614,370 B2 * 11/2009 Fischer et al. ..... 123/90.15

FOREIGN PATENT DOCUMENTS

JP 2005-299604 A 10/2005

* cited by examiner

*Primary Examiner*—Ching Chang
(74) *Attorney, Agent, or Firm*—Foley & Lardner LLP

(57) ABSTRACT

A variable valve timing control apparatus of an internal combustion engine has a drive rotary member rotated by an engine crankshaft, a driven rotary member fixedly connected to a camshaft and transferring a turning force from the drive rotary member to the camshaft, and a phase-change mechanism changing a relative rotational phase between the drive and driven rotary members and having an intermediate rotary member installed between the drive and driven rotary members for a relative rotational phase control. The variable valve timing control apparatus further has a holding mechanism and a releasing mechanism. The holding mechanism forces the intermediate rotary member and holds the relative rotational phase between the drive and driven rotary members, and the releasing mechanism releases a holding state of the holding mechanism.

24 Claims, 11 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open/close timing of an intake valve and/or an exhaust valve of the engine via hysteresis brake.

In recent years, there have been proposed and developed various variable valve timing control apparatuses. One such variable valve timing control apparatus has been disclosed in Japanese Patent Provisional Publication No. 2005-299604 (hereinafter is referred to as "JP2005-299604").

The variable valve timing control apparatus disclosed in JP2005-299604 includes a timing sprocket to which a torque (turning force) is transferred from a crankshaft of an engine, a camshaft relatively rotatably supported within a predetermined angular range with respect to the timing sprocket, a sleeve fixedly connected to the camshaft, and a rotational phase control mechanism (or a relative angular phase control or shift mechanism) provided between the timing sprocket and the sleeve so as to control or shift a rotational phase of the camshaft relative to the timing sprocket in accordance with an engine operation condition.

The rotational phase control mechanism includes a radial direction guide window formed in the timing sprocket, a spiral guide (a spiral guide groove) formed on a surface of a spiral guide disk, a link member having two end portions: a base end acting as a pivot and a top end portion slidably supported in the radial direction guide window so that the top end portion can slide in a radial direction along the radial direction guide window, an engagement portion which is provided at the top end portion of the link member and whose top end (a spherical portion or a semi-spherical protrusion) is engaged with the spiral guide, and a hysteresis brake applying a braking force to the spiral guide disk according to the engine operating condition.

When energizing an electromagnetic coil of the hysteresis brake, an electromagnetic brake acts on the spiral guide disk via a hysteresis member. By this braking action, the engagement portion (the top end portion) of the link member moves or slides in the radial direction along the radial direction guide window while being guided by the spiral guide. The sleeve (also the camshaft) can therefore be rotated relative to the timing sprocket within the predetermined angular range. With this, the open/close timing of the intake valve is variably controlled in accordance with the engine operating condition.

SUMMARY OF THE INVENTION

In general, the variable valve timing control apparatuses, such as JP2005-299604, are required to achieve the following two mutually opposite controls; one is that the engine should be started while holding the relative rotational phase position of the sleeve and the timing sprocket to a predetermined position suitable for the engine start when starting the engine, in particular, when cranking the engine with a long detection time period required to detect the relative rotational phase between the timing sprocket and the sleeve, and the other is that the relative rotational phase should be quickly changed with high response in accordance with the engine operating condition after the engine start.

However, in the above variable valve timing control apparatuses such as JP2005-299604, in order to achieve the high response for mainly normal driving, the variable valve timing control apparatus is designed so that a speed of changing or shifting the relative rotational phase becomes high, i.e. so that the relative rotational phase is quickly changed. It is therefore difficult to hold the relative rotational phase position to a predetermined relative rotational phase angle of the engine start.

It is therefore an object of the present invention to provide a variable valve timing control apparatus which can solve the above problems.

According to one aspect of the present invention, a variable valve timing control apparatus of an internal combustion engine, comprises: a drive rotary member rotated by an engine crankshaft; a driven rotary member fixedly connected to a camshaft and transferring a turning force from the drive rotary member to the camshaft; a phase-change mechanism changing a relative rotational phase between the drive and driven rotary members, the phase-change mechanism including: an intermediate rotary member installed between the drive and driven rotary members for a relative rotational phase control and having a guide; a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a holding mechanism which forces the intermediate rotary member and holds the relative rotational phase between the drive and driven rotary members at a predetermined relative rotational phase position; and a releasing mechanism which releases a holding state of the holding mechanism.

According to another aspect of the present invention, a variable valve timing control apparatus of an internal combustion engine, comprises: a drive rotary member rotated by an engine crankshaft; a driven rotary member fixedly connected to a camshaft and transferring a turning force from the drive rotary member to the camshaft; a phase-change mechanism changing a relative rotational phase between the drive and driven rotary members, the phase-change mechanism including: an intermediate rotary member installed between the drive and driven rotary members for a relative rotational phase control and having a guide; a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a relative rotational position between the intermediate rotary member and the driven rotary member is held by shifting the intermediate rotary member in one axial direction, and a holding state of the relative rotational position is released by shifting the intermediate rotary member in the other axial direction.

According to a further aspect of the invention, a variable valve timing control apparatus of an internal combustion engine, comprises: a drive rotary member rotated by an engine crankshaft; a driven rotary member fixedly connected to a camshaft and transferring a turning force from the drive rotary member to the camshaft; a phase-change mechanism changing a relative rotational phase between the drive and driven rotary members, the phase-change mechanism including: an intermediate rotary member installed between the drive and driven rotary members for a relative rotational phase control and having a guide; a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a holding mechanism which provides the intermediate rotary member with a frictional resistance and holds the relative rotational phase between the drive and driven rotary members at a predetermined relative rotational phase position; and a releasing mechanism which releases the holding mechanism according to an energizing condition of an electromagnetic coil.

According to the present invention, by pressing the intermediate rotary member toward the phase-change mechanism by the holding mechanism in accordance with an engine operating condition and by releasing a pressing force of the holding mechanism by the releasing mechanism, it is possible to hold the relative rotational phase angle between the drive rotary member and the camshaft at a predetermined rotational angle position and also to instantly or quickly convert the relative rotational phase angle to a target rotational phase angle after the release of the holding state.

Consequently, in any condition of the relative rotational phase angle, the phase angle can be maintained, and a stable phase angle holding performance can be obtained. In addition, by the release of the holding state, the change of the relative rotational phase after the release can be quickly performed. Accordingly, these two performances are obtained.

The other objects and features of this invention will become understood from the following description with reference to the accompanying drawings.

BRIEF DESCRIPTION OF THE DRAWINGS

FIG. 3A is a holding state (or locking state), FIG. 3B is a release state (or unlocking state).

FIG. 10A is a holding state (or locking state), FIG. 10B is a release state (or unlocking state).

FIG. 13A is a holding state (or locking state), FIG. 13B is a release state (or unlocking state).

DETAILED DESCRIPTION OF THE INVENTION

Embodiments of a variable valve timing control apparatus of an internal combustion engine will be explained below with reference to the drawings. In the following description, the terms "front" and "rear" are used for purposes of locating one element relative to another and are not to be construed as limiting terms. And in FIGS. 1 to 3A and 3B, 8 to 10A and 10B, and 12 and 13A and 13B, "front side" is a side of a torsion spring (coil spring) 16 (described later), and "rear side" is a side of a camshaft 1 (also described later). Further, although each embodiment below is applied to control of open/close timing of an intake valve for the internal combustion engine, it can also be applied to control of open/close timing of an exhaust valve.

First Embodiment

Figure 1:
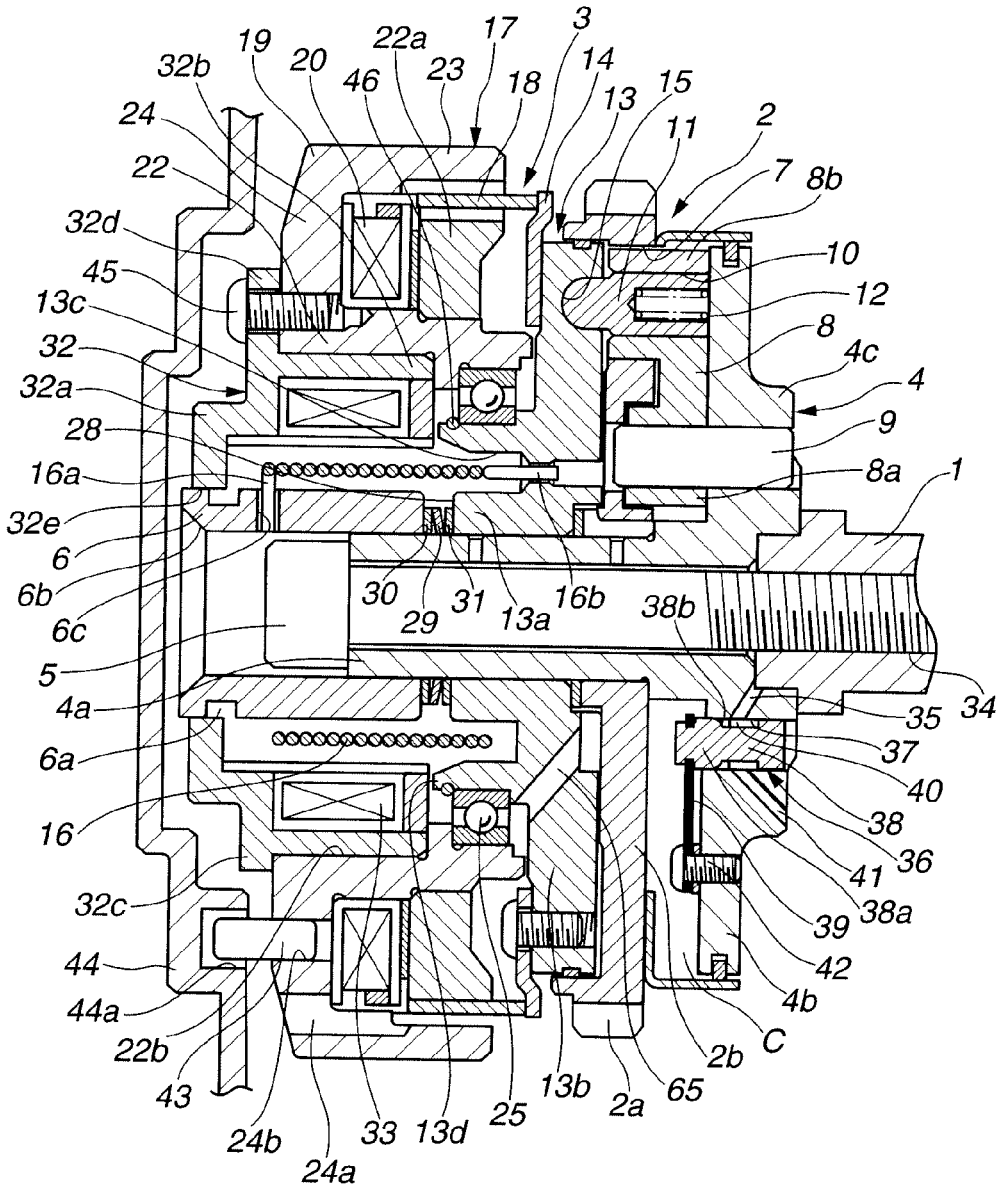
FIG. 1 is a longitudinal cross section of a variable valve timing control apparatus of an internal combustion engine, of a first embodiment.
Figure 2:
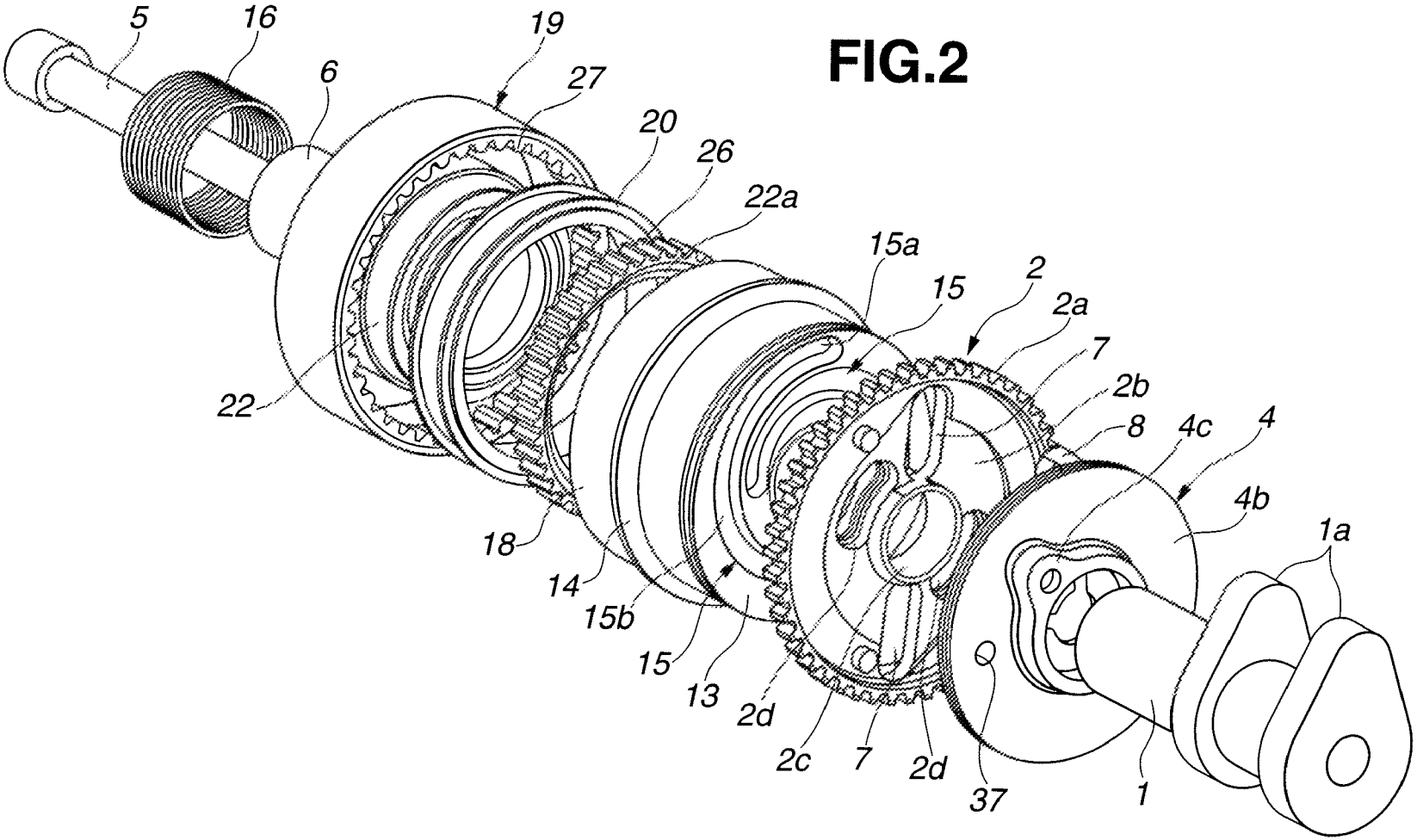
FIG. 2 is a perspective exploded view of the variable valve timing control apparatus.

The variable valve timing control apparatus of a first embodiment will be now explained with reference to FIGS. 1 to 7. As shown in FIGS. 1 and 2, the variable valve timing control apparatus (VTC) has a camshaft 1 rotatably supported on a cylinder head (not shown) of the engine, a timing sprocket 2 (as a drive rotary member or driving member capable of rotating relative to the camshaft 1) rotatably disposed at front side of the camshaft 1, and a relative angular phase control mechanism (simply, a phase converter or a phase-change mechanism) 3 disposed inside the timing sprocket 2 so as to change or control a relative rotational phase (or simply, a relative phase) between the camshaft 1 and timing sprocket 2.

The camshaft 1 has two cams 1*a*, 1*a* for each cylinder, which are disposed on an outer peripheral surface of the camshaft 1 to actuate respective intake valves (not shown), a driven rotary member (driven shaft member, or driven member) 4 connected with a front end of the camshaft 1 by a cam bolt 5 so that the driven rotary member 4 and the camshaft 1 are coaxially aligned with each other, and a sleeve 6 which is press-fitted and fixed to a front end portion of the driven rotary member 4.

The driven rotary member 4 has a cylindrical-shaped shaft portion 4*a* and a large-diameter flange portion 4*b*. The shaft portion 4*a* is provided with an insertion hole for receiving therethrough the cam bolt 5. The flange portion 4*b* is integrally formed with the shaft portion 4*a* at a rear end portion of the shaft portion 4*a* (in a position axially corresponding to the front end of the camshaft 1).

The sleeve 6 is fixed on an outer periphery of the front end portion of the shaft portion 4*a* of the driven rotary member 4 by the press-fitting, and a ring shape groove 6*a* is formed on an outer periphery of a front end portion of the sleeve 6. Further, a tapered surface 6*b* is formed in an inner edge of the front end portion of the sleeve 6 to smoothly receive and insert the cam bolt 5 into the insertion hole. Moreover, a hooking through-hole 6*c* to hook or secure a first end portion 16*a* of the coil spring (torsion spring) 16 is formed in a radial direction in a rear side portion of the ring shape groove 6*a*.

Regarding the timing sprocket 2, a plurality of sprocket teeth 2*a* are integrally formed with an outer circumference of the timing sprocket 2 in the circumferential direction. And then, the timing sprocket 2 with these ring-shaped sprocket teeth 2*a* is linked to an engine crankshaft (not shown) and turns via a timing chain (not shown). Further, the timing sprocket 2 has a plate member 2*b*, which is substantially disciform in shape, inside the sprocket teeth 2*a*. The plate member 2*b* is provided with an insertion hole 2*c* at a center thereof for receiving therethrough the shaft portion 4*a* of the driven rotary member 4. The plate member 2*b* (the timing sprocket 2) is therefore rotatably supported by the outer peripheral surface of the shaft portion 4*a* of the driven rotary member 4.

In addition, the plate member 2*b* is provided with two radial direction guide windows 7, 7 (as a radial guide) formed by parallel-opposed side walls respectively. More specifically, each of the radial direction guide windows 7, 7 is formed through the plate member 2*b* (that is, the radial direction guide windows 7, 7 penetrate the plate member 2*b*) such that each of the radial direction guide windows 7, 7 is arranged in a direction of a diameter of the timing sprocket 2. Further, two guide holes 2*d*, 2*d* are provided in the plate member 2*b* between the radial direction guide windows 7, 7 respectively (the two guide holes 2*d*, 2*d* also penetrate the plate member 2*b*). These radial direction guide window 7 and guide hole 2*d* are provided for receiving therethrough a top end portion 8*b* (described later) and a base end portion 8*a* (also described later) of a link member 8 (a follower portion, also described later), and therefore the top end portion 8*b* and the base end portion 8*a* can move or slide along the radial direction guide window 7 and the guide hole 2*d* respectively.

Each of the guide holes 2*d*, 2*d* is formed into arc-shape along a circumferential direction radially outside the hole 2*c*. And, a length in the circumferential direction of the guide hole 2*d* is set or dimensioned to a length corresponding to a movable range of the base end portion 8*a* (in other words, the length of the guide hole 2*d* is set to a length corresponding to a phase-shift range of relative rotational phase between the camshaft 1 and timing sprocket 2).

Each of the two link members 8, 8 (as a movable member) is formed into arc-shape, and has the above two end portions: the base end portion 8*a* and the top end portion 8*b*, at a front side of the flange portion 4*b* of the driven rotary member 4. The base end portion 8*a* and top end portion 8*b* are both formed into cylindrical-shape, and protrude toward the plate member 2*b* respectively. On the other hand, at a rear side of the flange portion 4*b* (at the side of camshaft 1), two protrusions 4*c*, 4*c*, which radially protrude, are integrally formed with each other and also with the driven rotary member 4. And further, a hole is provided at each of the protrusion 4*c* through the protrusion 4*c* and the flange portion 4*b*. One end portion of a pin 9 is fixed to the driven rotary member 4 by the press-fitting, and the other end portion of the pin 9 is rotatably fixed to the base end portion 8*a*. The base end portion 8*a* is, then, supported and rotatably or pivotally fixed to the driven rotary member 4 through the pin 9.

As mentioned above, the top end portion 8*b* of the link member 8 is slidably engaged in the radial direction guide window 7. The top end portion 8*b* is formed with a retaining hole 10 opening toward the front direction. And further, in this retaining hole 10, an engaging pin or engaging member 11 (as an engaged portion) having a spherical-shaped end at front end thereof and a coil spring 12 biasing the engaging pin 11 toward the front direction (toward a spiral guide groove or spiral groove 15 (described later)) through the radial direction guide window 7, are provided. Spherical-shaped end of the engaging pin 11 is slidably engaged in the spiral guide groove 15 (described later) of a spiral guide disk 13 (or spiral disk, also described later), and therefore the top end portion 8*b* moves or slides radially in and along the radial direction guide window 7 while being guided along the spiral guide groove 15.

More specifically, the top end portion 8*b* is slidably engaged with the radial direction guide window 7, and the base end portion 8*a* is rotatably fixed to the driven rotary member 4 through the pin 9. With this setting or configuration, when the top end portion 8*b* moves or slides radially in and along the radial direction guide window 7 by an external force which results from the engaging pin 11 guided by the spiral guide groove 15, the base end portion 8*a* moves or slides in and along the guide hole 2*d*. The driven rotary member 4 consequently rotates relative to the timing sprocket 2 in a circumferential direction corresponding to a radial movement direction of the top end portion 8*b* by a certain degree corresponding to a displacement of the top end portion 8*b*. (That is, an operating angle of the driven rotary member 4 is shifted by the rotation of the spiral guide disk 13.)

As for the disciform spiral guide disk 13 which is an intermediate rotary member and faces to a front side of the plate member 2*b*, the spiral guide disk 13 is rotatably supported on outer periphery of the shaft portion 4*a*. The spiral guide disk 13 has an inner periphery portion 13*a* that is slidably supported on the outer peripheral surface of the shaft portion 4*a* of the driven rotary member 4, and a disk portion 13*b* that is formed at an outer circumferential side of the inner periphery portion 13*a*. The inner periphery portion 13*a* is formed into a substantially cylindrical shape, and has an inner periphery side cylindrical portion and an outer periphery side cylindrical portion through a ring groove 13*c* that is formed in a front end side inner portion of the shaft portion 4*a*.

Each of the two spiral guide grooves 15, 15 is formed on a rear surface of the disk portion 13*b* (that is, at the side of the camshaft 1). The spiral guide groove 15 serving as a spiral guide is semi-circular in cross section. The spherical-shaped end of the engaging pin 11 of the link member 8 is slidably engaged with the spiral guide groove 15, and thereby being guided along the spiral guide groove 15.

Each of the spiral guide grooves 15, 15 is arranged separately from each other. And further, each spiral guide groove 15 is formed such that its spiral radius gradually reduces along a direction of rotation of the timing sprocket 2. More specifically, an outermost groove section 15*a* located at an outermost portion of the spiral guide groove 15 is formed to be bent inwardly at a given angle. Furthermore, the outermost groove section 15*a* is slightly inwardly bent further by a small angle around a central position of longitudinal length of the outermost groove section 15*a*.

That is to say, the spiral guide groove 15 has two sections: the outermost groove section 15*a* and a normal section 15*b* except outermost groove section 15*a*. A rate of change of spiral (rate of change of rotational phase) of the normal section 15*b* (or a convergence rate of the normal section 15*b*) is constant. In other words, the spiral radius of the normal section 15*b* gradually reduces along the direction of rotation of the timing sprocket 2. On the other hand, the convergence rate of the outermost groove section 15*a* is small as compared with that of the normal section 15*b*. That is, the outermost groove section 15*a* from a boundary point (an inflexion point) between the outermost groove section 15*a* and the normal section 15*b* up to the top end is formed in a substantially straight line along a tangent line of the spiral guide disk 13, and a length of the outermost groove section 15*a* is set to be relatively long. Furthermore, with respect to the outermost groove section 15*a*, its top end portion from an almost central portion (a bending point) of the length is formed to be inwardly slightly bent further by a very small angle.

When the spiral guide disk 13 relatively rotates in a retarding direction with respect to the timing sprocket 2 with the engaging pin 11 being engaged with the spiral guide groove 15, the top end portion 8*b* of the link member 8 moves in a radially inward direction in and along the radial direction guide window 7 while being guided by the spiral guide groove 15. At this time, the camshaft 1 is rotated in an advancing direction. On the other hand, when the spiral guide disk 13 relatively rotates in an advancing direction with respect to the timing sprocket 2, the top end portion 8*b* moves in a radially outward direction. Here, when the engaging pin 11 (also the top end portion 8*b*) comes to the inflexion point while being guided, the camshaft 1 is most retarded.

And further, when the spiral guide disk 13 is controlled to be rotated further, the engaging pin 11 (also the top end portion 8*b*) is guided and positioned at a top end portion of the outermost groove section 15*a*. At this time, a phase of the camshaft 1 is slightly shifted from the above most-retarded phase position to a slightly advanced phase position suitable for an engine starting (simply, an engine start-up phase).

The above-mentioned spiral guide disk 13 is provided with a relative operating turning force with respect to the camshaft 1. When provided with the operating turning force, the top end portion 8*b* of the link member 8 is radially displaced in and along the radial direction guide window 7 by the operating force via the spherical-shaped end of the engaging pin 11 guided by the spiral guide groove 15. At this time, by way of motion-conversion mechanism or working of the link member 8, the driven rotary member 4 is displaced in the direction of rotation thereof or is relatively rotated with respect to the timing sprocket 2 by the turning force. That is, the link member 8 slidably engaged in the radial direction guide window 7 and the spiral guide groove 15 serve to convert the radial displacement of the top end portion 8*b* along the radial direction guide window 7 into the circumferential displacement of the base end portion 8*a* along the guide hole 2*d*. In other words, the link member 8 rockably linked to both of the radial direction guide window 7 and the spiral guide groove 15 acts as a motion converter, and therefore the driven rotary member 4 is rotated.

As illustrated in FIGS. 1 and 2, a mechanism for applying the operating force or control force includes the torsion spring 16 (as a biasing device, as a means for forcing or driving) permanently forcing the spiral guide disk 13 in the rotational direction of the timing sprocket 2 via the sleeve 6, a hysteresis brake 17 (an electromagnetic driving or, simply, driving unit or section) that selectively generates a braking force against a force of the torsion spring 16 to force the spiral guide disk 13 in the reverse direction with respect to the rotation of the timing sprocket 2, and a controller (ECU: electrical control unit, output section, not shown) that controls the braking force of the hysteresis brake 17 according to the engine operating condition. By way of controlling the braking force of the hysteresis brake 17 appropriately by the controller in accordance with the engine operating condition, the spiral guide disk 13 is relatively rotated with respect to the timing sprocket 2, or these rotational positions are held or maintained.

As can be seen from FIG. 1, the torsion spring 16 is disposed outside the sleeve 6. And the first end portion 16*a* of the torsion spring 16 is radially inserted into the hooking through-hole 6*c* formed at the front end portion of the sleeve 6 and is fixed to the sleeve 6. On the other hand, a second end portion 16*b* of the torsion spring 16 is inserted into a hole formed in an inner axial direction of the inner periphery portion 13*a* and is fixed to the spiral guide disk 13. The torsion spring 16 serves to force and turn the spiral guide disk 13 in a direction of a starting rotational phase after the engine has stopped.

With respect to the hysteresis brake 17, the hysteresis brake 17 includes an annular plate 14 which is a non-magnetic material and is secured to a front outer periphery of the spiral guide disk 13 with a screw, a hysteresis ring 18 fixed to a front edge surface of the annular plate 14, a first annular coil yoke 19 arranged at a front side of the hysteresis ring 18, and a first electromagnetic coil 20 circumferentially surrounded with the first coil yoke 19 to induce magnetic flux in the first coil yoke 19.

The annular plate 14 is formed from an austenitic stainless material and formed into a ring shape having a certain width. The annular plate 14 is fixed to a front outer surface of the spiral guide disk 13 with welding, and its outside diameter is designed to be greater than that of the spiral guide disk 13.

As illustrated in FIG. 1, the hysteresis ring 18 is formed into a small cylindrical shape, and its width in radial direction is designed to be much smaller than that of the annular plate 14. As mentioned above, the hysteresis ring 18 is fixed to an outer circumferential side of the front edge surface of the annular plate 14 with welding. The hysteresis ring 18 is made of a magnetically semi-hardened material (i.e. a hysteresis material) having a characteristic showing a change of magnetic flux with phase lag behind a change of external magnetic field.

The first coil yoke 19 is substantially formed into a shape of a square bracket ([) in cross section, and has an inner stator 22 on an inner circumferential side, an outer stator 23 on an outer circumferential side and an annular yoke 24 that integrally forms the both inner and outer stators 22 and 23 at respective front sides. The first coil yoke 19 as a whole is formed into a substantially cylindrical shape such that the first coil yoke 19 circumferentially surrounds the first electromagnetic coil 20 inside the first coil yoke 19.

The inner stator 22 has an annular stator portion 22*a* that is integrally fixed to an outer circumferential side of the inner stator 22 by press-fitting, and further has a ball bearing 25 between an inner circumferential side of the inner stator 22 and the inner periphery portion 13*a* of the spiral guide disk 13 to rotatably support the spiral guide disk 13 with respect to the inner stator 22. Regarding this ball bearing 25, its movement or shift outward in the axial direction is limited by a C-ring 46 that is fixed on a front side outer circumferential surface of the spiral guide disk inner periphery portion 13*a*. Further, the ball bearing 25 links the hysteresis brake 17 and the spiral guide disk 13 so that these hysteresis brake 17 and spiral guide disk 13 are able to shift together in the axial direction.

The inner stator 22 (the annular stator portion 22*a*) and the outer stator 23 have inner pole teeth 26 and outer pole teeth 27 respectively on outer circumferential side of the inner stator 22 and on inner circumferential side of the outer stator 23 through a certain gap. These plurality of the opposed inner and outer pole teeth 26, 27 are arranged circumferentially at regular intervals. The inner pole teeth 26 are S (South) Pole and the outer pole teeth 27 are N (North) Pole. More specifically, each of the inner and outer pole teeth 26, 27 formed in projected shape and serving to generate magnetic field (as a magnetic field generating portion) is arranged circumferentially in a staggered configuration. Then, all the mutually close teeth between the opposed inner and outer pole teeth 26, 27 are shifted from each other in the circumferential direction.

Thus, upon energization of the first electromagnetic coil 20, magnetic field is generated between the opposed adjacent projected portions of the the inner and outer pole teeth 26, 27. That is, the magnetic field is generated at a certain angle relative to the circumferential direction of the hysteresis ring 18.

A top end portion of the hysteresis ring 18 (inner and outer circumferential surfaces of the hysteresis ring 18) is located in a cylindrical air gap between the circumferentially-opposed pole teeth 26, 27 with the top end portion in the non-contact with the pole teeth 26, 27. More specifically, an air gap between an outer circumferential surface of the top end portion and the outer pole teeth 27, and an air gap between an inner circumferential surface of the top end portion and the inner pole teeth 26, are set to infinitesimally small distances respectively to obtain a large magnetic force.

The annular yoke 24 is provided with a through hole 24*a* at a predetermined position in the circumferential direction of the annular yoke 24 in order to connect the first electromagnetic coil 20 and the controller via a harness (not shown). Further, a through hole 24*b* is formed in the axial direction in the annular yoke 24 to fix one end portion of an after mentioned pin 43 by press-fitting.

The first electromagnetic coil 20 generates the magnetic field through the first coil yoke 19 upon energization of the electromagnetic coil 20 by the controller via the harness, and produces a braking torque to the hysteresis ring 18 by this magnetic force. That is, when the first electromagnetic coil 20 induces magnetic flux in the first coil yoke 19 and the hysteresis ring 18 is displaced in the magnetic field between the opposed pole teeth 26, 27 by the energization of the electromagnetic coil 20, the braking force is generated due to a difference between a direction of magnetic flux in the hysteresis ring 18 and a direction of the magnetic field. As a result, the hysteresis brake 17 acts to brake the hysteresis ring 18 or to stop the rotation of the hysteresis ring 18. A strength of the braking force is independent of a rotational speed of the hysteresis ring 18 (i.e. a relative speed between the hysteresis ring 18 and opposed pole teeth 26, 27), but is substantially proportional to an intensity of the magnetic field (i.e. an amount of magnetizing current supplied to the first electromagnetic coil 20).

The controller detects a current engine operating condition on the basis of input information from a crank angle sensor detecting engine speed (engine rpm), an airflow meter detecting an engine load from an intake-air quantity, a throttle valve opening sensor, an engine temperature sensor and others (these are not shown). Further, the controller outputs a signal of control current supplied to the first electromagnetic coil 20 on the basis of an actual relative rotational position between the timing sprocket 2 and the camshaft 1 which is detected by a cam angle sensor and also a preset target relative rotational position.

Here, the relative angular phase control mechanism 3 has the radial direction guide window 7 of the timing sprocket 2, the link member 8, the engaging pin 11, the protrusion, the spiral guide disk 13, the spiral guide groove 15, and the hysteresis brake 17. Further, although the first coil yoke 19 is coupled with a VTC cover 44 through the pin 43 whose one end portion is press-fitted to the through hole 24*b* of the annular yoke 24 and other end portion is inserted into a fitting hole 44*a* of the VTC cover 44 by a whirl-stop or detent, the first coil yoke 19 is allowed to move or shift in the axial direction.

Furthermore, a holding or locking mechanism (or unit or means), which forces the spiral guide disk 13 in the axial direction and holds or locks the relative rotational position between the timing sprocket 2 and the camshaft 1 (the driven rotary member 4) to a certain relative rotational position, is provided between the sleeve 6 and the spiral guide disk 13. In addition, a releasing or unlocking mechanism (or unit or means), which releases or unlocks a holding state by the holding mechanism, is provided inside the first coil yoke 19.

The holding mechanism has an annular gap or space 28 formed between a rear end surface of the sleeve 6 and a front end surface of the inner periphery portion 13*a* of the spiral guide disk 13, and a spring such as a disc spring 29 of metal spring provided inside the annular space 28, and others.

In order to secure good sliding movement of the disc spring 29 and also of the spiral guide disk 13 when the disc spring 29 is deformed, ring-shaped retainers 30 and 31 are provided at both sides of the disc spring 29. The disc spring 29 pushes or presses the whole spiral guide disk 13 toward the right side (i.e. toward the camshaft 1) in FIG. 1 by its spring force, then an inner periphery surface of the spiral guide groove 15 is firmly pressed on a top end surface of the engaging pin 11. Through a frictional resistance or drag force due to this press, the rotation of the spiral guide disk 13 is restrained or prevented, and its relative rotational position is consequently maintained. This holding force, i.e. the frictional resistance force, can be set to any strength according to a spring set load of the disc spring 29. In this embodiment, the strength is not large but is set to be relatively small. As the metal spring, a wave spring washer could be provided other than the disc spring 29.

On the other hand, as for the releasing mechanism, it is formed by an electromagnet. The releasing mechanism has a second coil yoke 32 installed in a dead space that is located at the inner circumferential side of the inner stator 22 and also at the front position of the inner periphery portion 13*a* of the spiral guide disk 13, and a second electromagnetic coil 33 installed inside the second coil yoke 32.

The second coil yoke 32 is substantially formed into a shape of a square bracket ([) in cross section, and has a front side stator 32*a* and a rear side stator 32*b*. The front side stator 32*a* has a flange shape, and the rear side stator 32*b* is formed into a cylindrical shape. The front side and rear side stators 32*a*, 32*b* are integrally formed with each other at an almost central portion of a rear surface of the front side stator 32*a*. The second coil yoke 32 is fitted into a crank-shaped stepped surface that is formed at the inner circumferential side of the inner stator 22, and its position in the axial and radial directions is fixed by press-fitting.

The front side stator 32*a* is substantially formed into a crank-shape in cross section, and has an outer circumferential portion 32*c*. The outer circumferential portion 32*c* serves to limit a maximum press-fitting amount with respect to the inner stator 22. That is, the outer circumferential portion 32*c* touches a front side surface of the annular yoke 24, and a position of the second coil yoke 32 with respect to the inner stator 22 is ensured. Further, a plurality of protrusions 32*d*, each of which protrudes in the radial direction, are integrally formed with the outer circumferential portion 32*c* and arranged circumferentially at an outer circumferential edge of the outer circumferential portion 32*c*. Then, the each protrusion 32*d* is fixed to the inner circumferential side of the inner stator 22 with a bolt 45.

As illustrated in FIG. 1, an inner circumferential surface 32*e* of an inner circumferential portion of the front side stator 32*a* is shifted from the ring shape groove 6*a* of the sleeve 6 in the axial direction. A rear end side of the inner circumferential surface 32*e* faces the ring shape groove 6*a*, and a front end side of the inner circumferential surface 32*e* touches an outer circumferential surface of the sleeve 6. On the other hand, the rear side stator 32*b* is positioned so that its annular rear edge surface is close to an annular top surface of the inner periphery portion 13*a* of the spiral guide disk 13 through an infinitesimal gap.

The second electromagnetic coil 33 is supplied with a signal of energization (ON) or non-energization (OFF) by the controller via the harness. When supplied with ON signal, with the specific arrangement structure of the inner circumferential surface 32*e* of the front side stator 32*a* and the ring shape groove 6*a*, the second electromagnetic coil 33 moves or shifts the hysteresis brake 17 and the spiral guide disk 13 together with respect to the sleeve 6 toward the front direction (i.e. toward the direction of the VTC cover 44) by its magnetic force against a spring force of the disc spring 29.

In this embodiment, a cooling unit or section (an oil supply mechanism or means) for supplying a cooling oil to the relative angular phase control mechanism 3 is further provided.

The cooling unit has, as shown in FIG. 1, an annular oil passage 34 that is formed between the camshaft 1 and the cam bolt 5, an oil supply passage 35 which is opened at a certain angle or with an inclination from an inner circumferential side of the shaft portion 4*a* of the driven rotary member 4 to an inside of the flange portion 4*b* and whose upstream end communicates with the annular oil passage 34, and an oil flow quantity control or regulation valve 36 that controls a flow quantity of the cooling oil flowing through the oil supply passage 35 in accordance with an oil temperature.

The annular oil passage 34 communicates with a main oil gallery that supplies a lubricant discharged from an oil pump (not shown) to each sliding part of the engine, then part of the oil discharged from the oil pump flows into the annular oil passage 34.

As for the oil supply passage 35, its downstream end communicates with an inside of the relative angular phase control mechanism 3 through a valve hole 37 of the oil flow quantity control valve 36.

The oil flow quantity control valve 36 penetrates the flange portion 4*b* in the axial direction. The oil flow quantity control valve 36 has the valve hole 37 that communicates with the downstream end of the oil supply passage 35, a valve body 38 that is slidably installed inside the valve hole 37, and a thermostatic member 39 which bends or curves according to an atmosphere temperature including the temperature of the supplied oil and slides the valve body 38 inside the valve hole 37, and others.

The valve hole 37 is provided at the inner circumferential side of the flange portion 4*b*, and its inside diameter is substantially formed into a uniformly cylindrical shape. More specifically, one end opening of the valve hole 37 faces or communicates with a space C between the flange portion 4*b* and the plate member 2*b* of the timing sprocket 2. Further, the above mentioned downstream end of the oil supply passage 35 communicates with an almost central position in the axial direction of the valve hole 37.

The valve body 38 is substantially formed into a stepped and cylindrical shape. The valve body 38 has a small diameter shaft portion positioned at an almost central portion of the valve body 38, a cylindrical land portion which is integrally formed with a rear end of the small diameter shaft portion and whose outer circumferential surface makes sliding contact with an inner circumferential surface of the valve hole 37, a cylindrical valve portion 38*a* which is integrally formed with a front end of the small diameter shaft portion and whose outer circumferential surface makes sliding contact with the inner circumferential surface of the valve hole 37, and a stopper portion integrally formed with a top end of the cylindrical valve portion 38*a*.

Between an outer circumferential surface of the small diameter shaft portion and the inner circumferential surface of the valve hole 37, as can be seen in FIG. 1, a ring-shaped oil induction space 40 is formed. Then the downstream end of the oil supply passage 35 communicates with the oil induction space 40. Further, a discharge passage 41 is formed at an opposite side to the oil supply passage 35. That is, the discharge passage 41 and the oil supply passage 35 are placed on opposite sides of the valve hole 37. This discharge passage 41 discharges an excess of oil flowing into the oil induction space 40 to an outside. The discharge passage 41 is designed so that its cross-sectional area is much smaller than that of the oil supply passage 35. More specifically, the cross-sectional area of the discharge passage 41 is set to such size that the oil temperature is transferred or conveyed to the thermostatic member 39 through the flange portion 4*b* etc. at a time of low oil temperature.

An inner end surface of the land portion and an inner end surface of the cylindrical valve portion 38*a* which is opposite to the inner end surface of the land portion are formed as a pressure receiving area of the incoming oil to the oil induction space 40, and projected areas of these pressure receiving areas are the same. Further, each outside diameter of the land portion and the valve portion 38*a* is designed to be slightly smaller than an inside diameter of the inner circumferential surface of the valve hole 37. More specifically, to secure good sliding movement of the valve body 38, an infinitesimal or minute clearance is formed between the outer circumferential surfaces of the land portion and the valve portion 38*a* and the inner circumferential surface of the valve hole 37. This minute clearance is set to such size that an oil slick or film can be formed between these inner and outer circumferential surfaces.

The oil induction space 40 is designed so that its cross-sectional area is greater than the sum total of each cross-sectional area of the oil supply passage 35, the discharge passage 41 and after mentioned control passage grooves 38*b*.

The valve portion 38*a* has a pair of the control passage grooves 38*b* which are mutually positioned at approximately 180° position in circumferential direction of the outer circumferential surface of the valve portion 38*a*. The control passage groove 38*b* has a stepped-shape and inclines upward from a side of the pressure receiving area. More specifically, the control passage groove 38*b* has a lowest flat plane that is formed at the pressure receiving area side, an inclined or tilted plane that inclines in a slanting direction toward front upper direction from the flat plane, and a top end plane which is formed at a top end side of the inclined plane and slightly inclines.

The thermostatic member 39 is formed by four layer rectangular thin metal plates such as a bimetal. The thermostatic member 39 has a base end portion whose outline is formed into an arc shape and a top end portion which is formed into a rectangular shape. The base end portion is provided with a bolt insertion hole. On the other hand, the top end portion is provided with a forked or bifurcated stopper that pinches and fixes the top end portion to the stopper portion of the valve body 38 through an almost U-shaped stopper groove. The base end portion is secured to the flange portion 4*b* through a bolt 42 inserted into the bolt insertion hole via a washer.

The oil supplied to the space C is supplied between the plate member 2*b* and the disk portion 13*b* through a periphery such as the base end portion 8*a* of the link member 8, and further supplied to the ball bearing 25, the hysteresis ring 18, and between the inner and outer pole teeth 26, 27 and so on through an oil hole or tube 65 that is formed in the disk portion 13*b*.

In the following, basic operation of the variable valve timing control apparatus of this embodiment will be explained.

In the engine stop state, by de-energizing the first electromagnetic coil 20 by the controller, since the working of an electromagnetic braking mechanism is stopped, the spiral guide disk 13 is rotated fully in the rotational direction of the engine with respect to the timing sprocket 2 by way of the spring force of the torsion spring 16. At this time, the spherical-shaped end of the engaging pin 11 is shifted and positioned at the top end portion of the outermost groove section 15*a* of the spiral guide groove 15, and therefore the rotational phase of the camshaft 1 relative to the engine crankshaft is shifted to the engine start-up phase, which is the slightly advanced phase position as compared with the most-retarded phase position, and is maintained at this position. That is to say, engine valve open and closure timings at the engine start-up are set to suitable timings for the engine start-up.

Figure 3A:
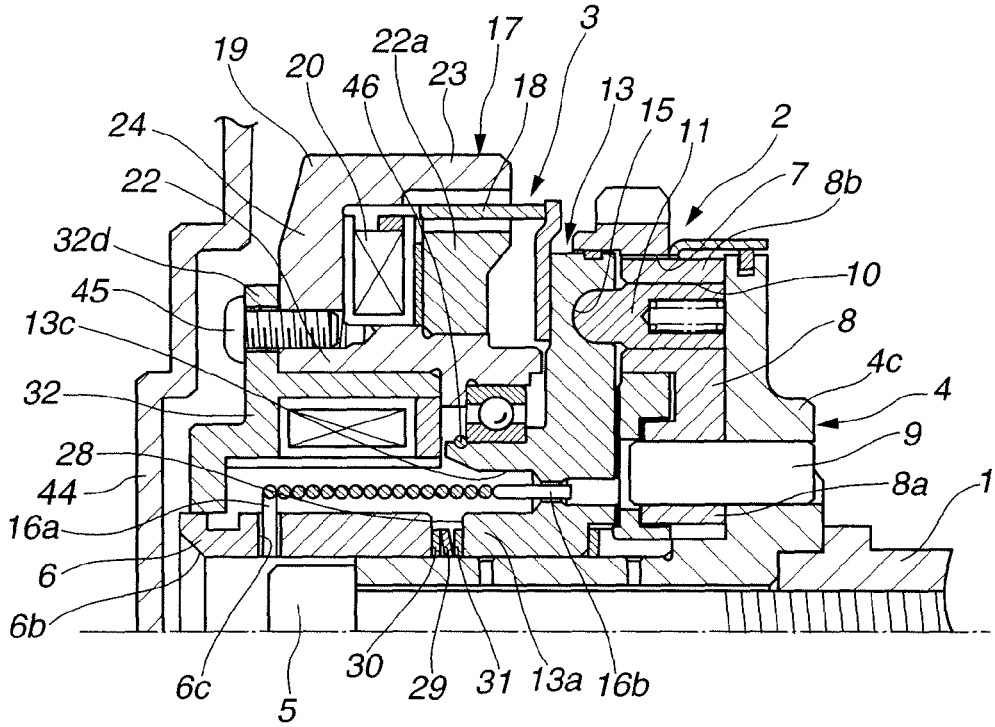
FIGS. 3A and 3B are drawings that explain actions according to the first embodiment.

At the same time as the de-energization of the first electromagnetic coil 20, the second electromagnetic coil 33 is supplied with the OFF signal by the controller. At this time, as illustrated in FIG. 3A, the hysteresis brake 17 and the spiral guide disk 13 are forced and shifted together toward the rear direction, i.e. toward the right direction in the drawing, by the spring force of the disc spring 29, then the inner periphery surface of the spiral guide groove 15 is firmly pressed on the top end surface of the engaging pin 11 in the axial direction. The spiral guide disk 13 is therefore securely maintained at the predetermined slightly advanced phase position suitable for the engine start-up with stability. With regard to the detailed control when stopping the engine, it will be described later.

Next, when turning the ignition on and starting to crank the engine, the second electromagnetic coil 33 is not energized yet at this time by the controller and remains in a non-energized state. Thus the spiral guide disk 13 remains in the holding state in which the spiral guide disk 13 is maintained at the slightly advanced phase position set at the engine stop. Consequently, thanks to an optimum relative rotational phase between the camshaft 1 and timing sprocket 2, a good engine startability can be ensured.

Figure 3B:
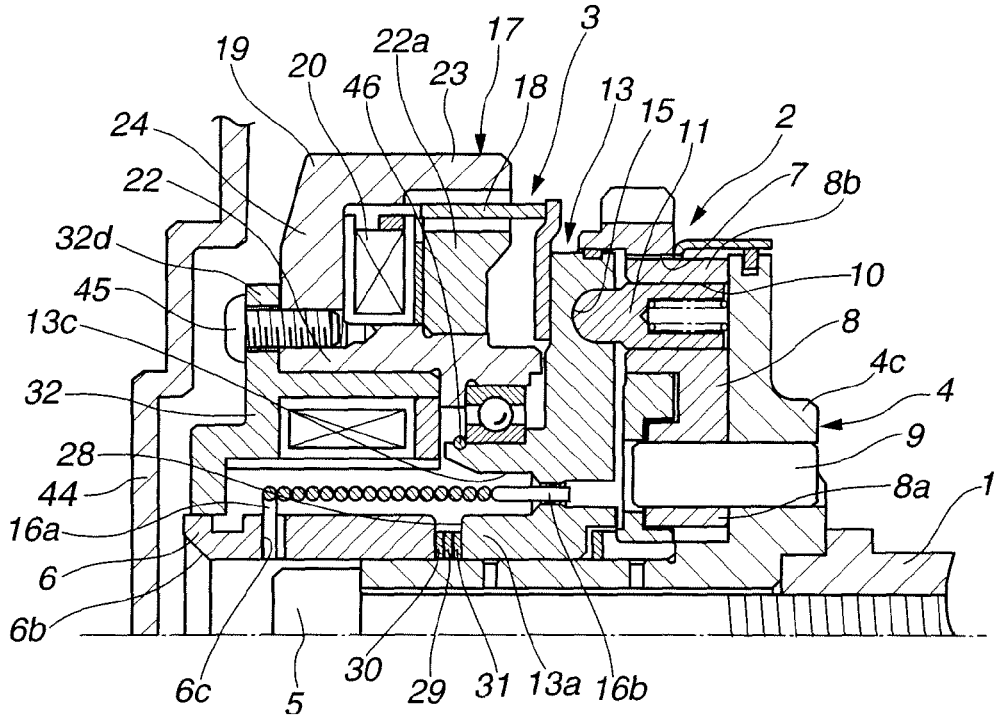

After the engine cranking, when shifted to a first idling operation, the second electromagnetic coil 33 is energized by the controller. Then, by the magnetic (electromagnetic) attraction generated at the second coil yoke 32, as shown in FIG. 3B, the spiral guide disk 13 is slightly moved or shifted to the front direction (in the left direction in the drawing) against the spring force of the disc spring 29. With this shift, a firmly pressed state between the spiral guide groove 15 of the spiral guide disk 13 and the engaging pin 11 by the disc spring 29 is released, and thus allows a free rotation of the spiral guide disk 13.

When shifted to a low-rpm condition such as a subsequent idling condition, the first electromagnetic coil 20 is also energized by the controller. Then with this excitation, the braking torque is generated at the hysteresis ring 18, and the braking force against the spring force of the torsion spring 16 is provided to the spiral guide disk 13.

The engaging pin 11 therefore moves from the top end side of the outermost groove section 15*a* toward the inflexion point in the spiral guide groove 15 rapidly, and the spiral guide disk 13 slightly rotates relatively in the reverse direction to the rotation of the timing sprocket 2. By this relative rotation, the engaging pin 11 (also the top end portion 8*b*) of the link member 8 moves in the radially outward direction in and along the radial direction guide window 7 while being guided by the spiral guide groove 15. Thus, a rotational phase of the driven rotary member 4 relative to the timing sprocket 2 is shifted toward the most-retarded phase position via the motion-conversion mechanism or working of the link member 8.

As a result, the rotational phase of the camshaft 1 relative to the engine crankshaft (i.e. the rotational phase between the camshaft 1 and the engine crankshaft) is shifted to a desired phase according to the engine operating condition. For instance, it is the retarded phase position or the most-retarded phase position suitable for the low-rpm conditions. This can therefore improve not only the stability of rotation of the engine but also fuel economy at the idling condition.

After this condition, when shifted to a high-rpm condition under a normal or typical driving condition, in order to shift the rotational phase toward the most-advanced phase position, further larger control current is supplied to the first electromagnetic coil 20 by the controller. When the hysteresis ring 18 of the spiral guide disk 13 receives the braking force by the above control current, the spiral guide disk 13 relatively rotates further in the reverse direction to the rotation of the timing sprocket 2. And therefore, the engaging pin 11 is guided by the spiral guide groove 15 and moves toward an innermost portion of the normal section 15*b*, and also the top end portion 8*b* moves in the radially inward direction in and along the radial direction guide window 7. Thus, the rotational phase of the driven rotary member 4 relative to the timing sprocket 2 is shifted toward the most-advanced phase position by the motion-conversion mechanism or working of the link member 8. As a result, the rotational phase of the camshaft 1 relative to the engine crankshaft is shifted toward the most-advanced phase position. This can bring about a high power generation of the engine.

As explained above, when changing the rotational position of the spiral guide disk 13 in the retarding or advancing direction in accordance with the change of the engine operation, the controller sends the ON signal to the second electromagnetic coil 33 (i.e. energizes the second electromagnetic coil 33) before changing the rotational position of the spiral guide disk 13. Then the holding force by the disc spring 29 is released and the free rotation of the spiral guide disk 13 is allowed. On the other hand, when holding or maintaining the rotational phase between the camshaft 1 and the engine crankshaft to the desired phase, the controller sends the OFF signal to the second electromagnetic coil 33 (i.e. de-energizes the second electromagnetic coil 33), then by the spring force of the disc spring 29, the rotation or rotational position of the spiral guide disk 13 is maintained.

Consequently, in any condition of the relative rotational phase angle, the phase angle can be maintained is as described above, and a stable phase angle holding performance can be obtained. In addition, since the holding state by way of the disc spring 29 is released by energizing the second electromagnetic coil 33, the change of the relative rotational phase after the release can be quickly performed. Accordingly, these two performances are obtained in this embodiment.

Next, a detailed operation or working and control by the disc spring 29 of the holding means and the electromagnet such as the second electromagnetic coil 33 of the releasing means upon the change of the engine operation will be explained below.

Firstly, a routine of a process in which the controller sends the ON/OFF signal to the second electromagnetic coil 33 will be explained with reference to a flow chart in FIG. 4. Here, this routine is performed, for example, at 10 ms cycle time.

At step S1, a judgment is made as to whether or not a deviation of an actual phase angle between a current crankshaft and camshaft, detected by the crank angle sensor and the cam angle sensor, from a preset target relative rotational phase angle is greater than or equal to a specified or certain value (a threshold value) under the normal driving condition after the engine start-up.

If the deviation is smaller than the threshold value, the routine proceeds to step S5. At step S5, since the actual phase angle is close to the target relative rotational phase angle, the controller sends the OFF signal to the second electromagnetic coil 33, and thereafter sends the OFF signal to the first electromagnetic coil 20 as well, then the routine returns to step S1. Thus the spiral guide disk 13 is pressed toward the side of the engaging pin 11 together with the hysteresis brake 17 by the spring force of the disc spring 29, and the inner periphery surface of the spiral guide groove 15 is firmly pressed on the top end surface of the engaging pin 11, as shown in FIG. 3A. Thanks to this, since the timing sprocket 2 and the camshaft 1 are held and put in the locking state at a certain relative rotational angle, the operating force of the first electromagnetic coil 20 disappears, and the phase angle is maintained.

With regard to this locking state, it is a completely fixed state that is unaffected by all of the input, such as a restoring force of the torsion spring 16, the electromagnetic braking force produced by energizing the first electromagnetic coil 20, and a cam torque input to the camshaft 1 etc.

At step S1, if the deviation is greater than or equal to the threshold value (namely if YES), the routine proceeds to step S2. At step S2, the controller energizes the first electromagnetic coil 20 first, and raises its operating force. That is, the operating force, which relatively rotates the spiral guide disk 13 with respect to the timing sprocket 2 against the spring force of the torsion spring 16 by providing the electromagnetic braking force to the spiral guide disk 13 for changing the rotational phase of the driven rotary member 4, is increased in advance before rotating the spiral guide disk 13.

After that, the controller sends the ON signal to the second electromagnetic coil 33, and as explained above and illustrated in FIG. 3B, shifts the spiral guide disk 13 and the hysteresis brake 17 to the front direction (in the left direction in the drawing) against a pressing force (holding force) by the disc spring 29 by this energization. Then a firmly pressing force between the inner periphery surface of the spiral guide groove 15 and the top end surface of the engaging pin 11 is lowered and the holding force is released, namely that the locking state is released.

Subsequently, at step S3, under the condition in which the holding state of the spiral guide disk 13 is released, the actual phase angle is maintained at a certain middle position (between the current rotational position and the target rotational position) by balancing the electromagnetic braking force produced by energizing the first electromagnetic coil 20 with the spring force of the torsion spring 16.

At step S4, the actual phase angle is quickly shifted up to the target relative rotational phase angle by controlling the magnetizing current supplied to the first electromagnetic coil 20, then the routine returns to step S1.

As described above, with this process, it is possible to instantly or quickly convert the relative rotational phase angle between the timing sprocket 2 and the camshaft 1 in accordance with the change of the engine operating condition.

Figure 5:
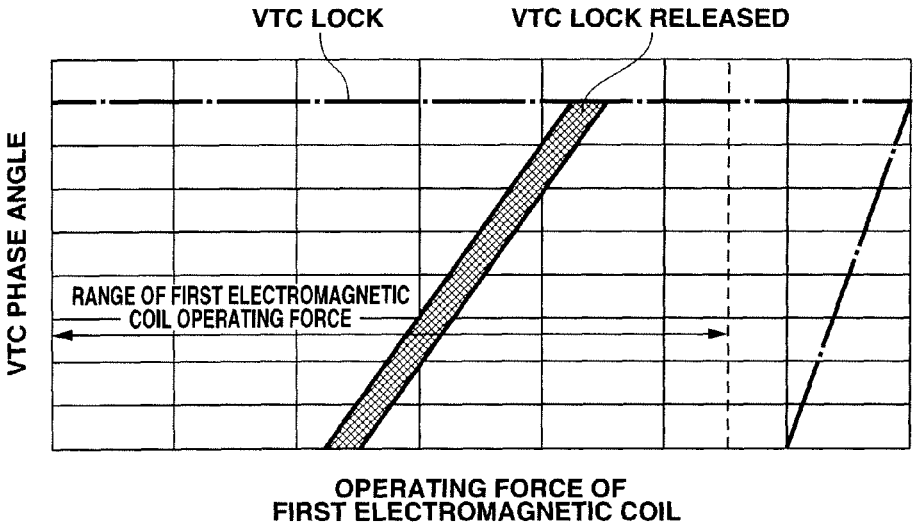
FIG. 5 is a characteristic drawing that illustrates a relationship between a control force (or operating force) of a first electromagnetic coil and a phase angle of a variable valve timing control apparatus (VTC).

In FIG. 5, a relationship between the control force (operating force) of the first electromagnetic coil 20 and the VTC phase angle (VTC: variable valve timing control), of the holding and releasing controls is shown. As can be seen also from this characteristic drawing, when the holding state of the spiral guide disk 13 is released by the releasing means (between bold lines) from the state in which the spiral guide disk 13 is held (locked) by the holding means (a chain line), the operating force by the first electromagnetic coil 20 immediately increases. Hence, an operating response of the VTC is widely improved.

Figure 4:
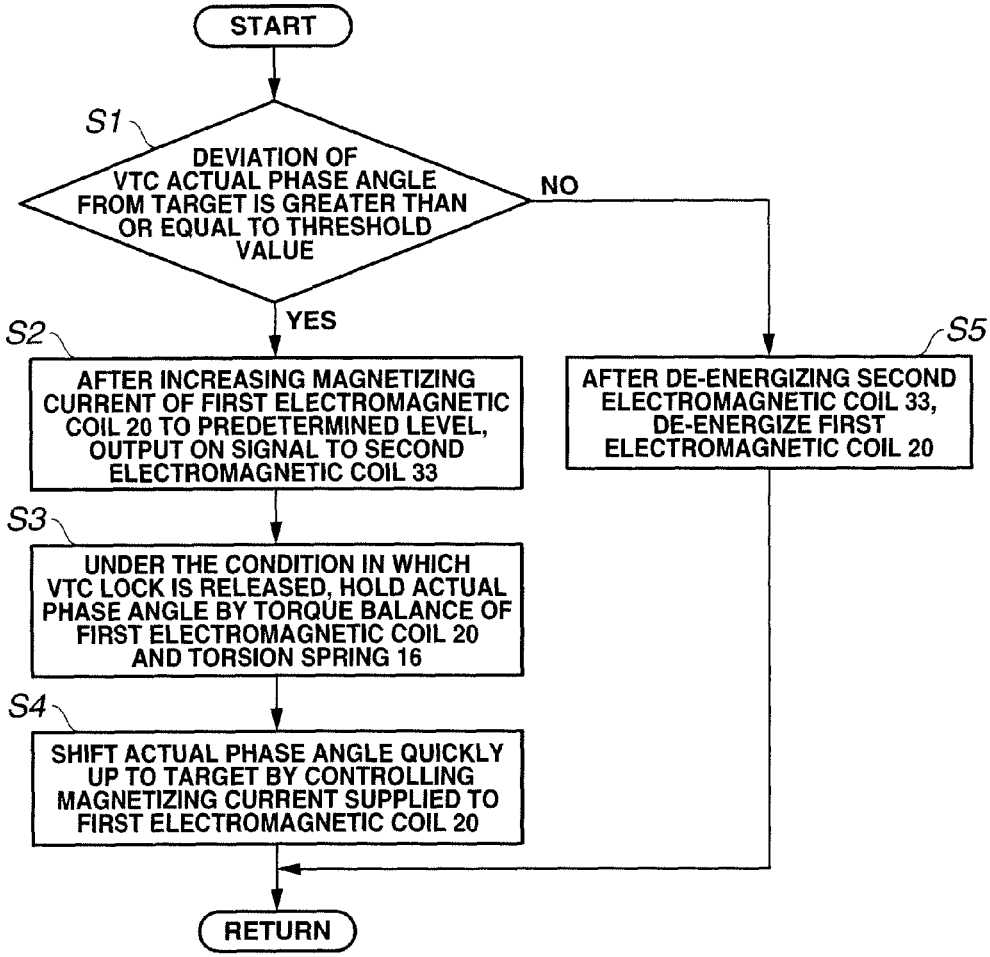
FIG. 4 is a control flow chart executed by a controller in the first embodiment.
Figure 6:
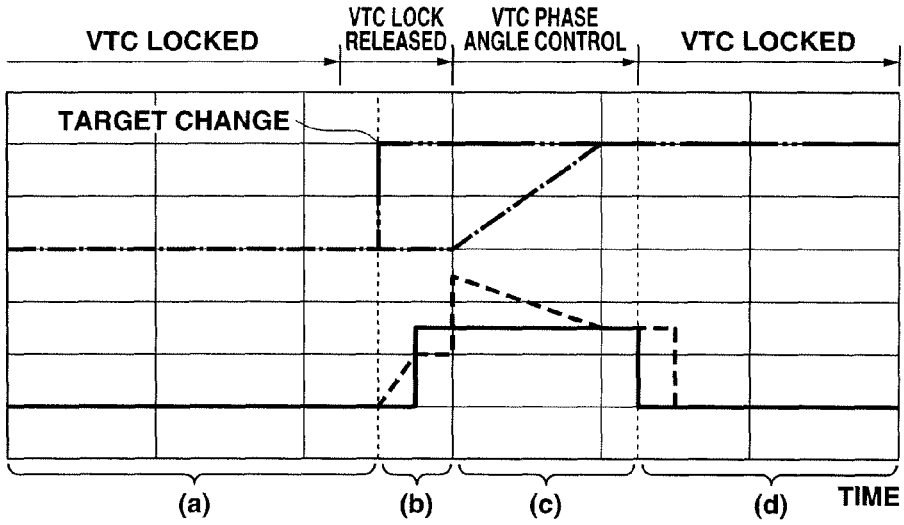
FIG. 6 is a drawing that illustrates a time chart of the control in the first embodiment.

FIG. 6 illustrates a time chart of the case of the operation in the advancing direction of VTC, which corresponds to FIG. 4. In FIG. 6, a chain line is the VTC phase angle, a two-dot chain line is the target angle (target relative rotational phase angle), a broken line is the operating or control amount by the energization of the first electromagnetic coil 20, and a solid line is the operating or control amount by the energization of second electromagnetic coil 33.

When the deviation of the actual phase angle between the timing sprocket 2 and the camshaft 1 from the target angle is small (time region (a)), as described above, both the first and second electromagnetic coils 20, 33 are de-energized and VTC is locked. When the deviation becomes large (time region (b)), the controller energizes the first electromagnetic coil 20 first and raises its operating force, then energizes the second electromagnetic coil 33 second and releases the holding state held by the disc spring 29. After that, by the working and operation by the torsion spring 16 and the first electromagnetic coil 20, the deviation is diminished (i.e. the VTC phase angle becomes closer to the target angle) (time region (c)).

Further, when the VTC phase angle is controlled and shifted to the most-advanced phase position by increasing the magnetizing current supplied to the first electromagnetic coil 20 and the deviation is small and also the phase angle become stabilized or settles down in the high-rpm condition (time region (d)), the controller de-energizes the second electromagnetic coil 33 and also de-energizes the first electromagnetic coil 20. With this control, VTC is maintained and locked in the state of the most-advanced phase by the spring force of the disc spring 29.

Figure 7:
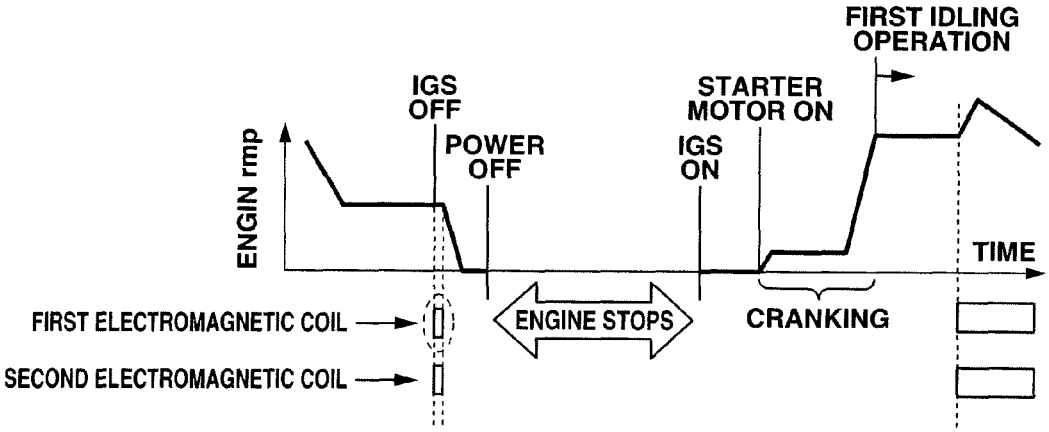
FIG. 7 is a control time chart from an engine stop to an engine restart in the first embodiment.

FIG. 7 illustrates a time chart from the engine stop to the engine restart. When an ignition switch (IGS) is turned OFF at the time of engine stop, the second electromagnetic coil 33 is energized and the holding state of the spiral guide disk 13 by the disc spring 29 is released, and further the first electromagnetic coil 20 is de-energized. The spiral guide disk 13 is therefore rotated to the rotational position of the engine start-up phase, where the engaging pin 11 (the top end portion 8*b*) is guided and positioned at the top end portion of the outermost groove section 15*a*, by the spring force of the torsion spring 16, then the timing sprocket 2 and the camshaft 1 are maintained (controlled) at the slightly advanced phase position from the most-retarded phase position.

Next, when the ignition switch (IGS) is turned ON at the time of engine start, a starter motor is turned ON and the engine cranking is started. After the engine cranking, the second electromagnetic coil 33 is energized just after the initiation of the first idling operation, and the holding state of the spiral guide disk 13 is released.

That is, during a period from the IGS-ON to the initiation of the first idling operation, the spiral guide disk 13 is pressed toward the side of the engaging pin 11 by the spring force of the disc spring 29, and the phase angle at the time of the engine stop is held. Hence, the good engine startability during the engine cranking can be ensured with stability.

After that, since the holding state is released by way of the magnetic attraction by the second electromagnetic coil 33 just after the initiation of the first idling operation, through the electromagnetic braking force by the first electromagnetic coil 20 and the spring force by the torsion spring 16, the most-retarded phase position control for the idling operation can be ensured and also the rotational phase angle suitable for the normal driving condition can be quickly set.

Further, in this embodiment, since the disc spring 29 is used as the holding means, there is no need to enlarge a length in the axial direction, of the variable valve timing control apparatus. In other words, a size of the apparatus becomes small as compared with a case using, for instance, a coil spring. This facilitates the installation of the apparatus to the engine.

In addition, the second electromagnetic coil 33 is energized only when releasing the holding state of the spiral guide disk 13. Thus its power consumption can be sufficiently reduced.

Furthermore, since the workings or mechanisms of the holding and releasing means are relatively simple, manufacturing or assembling or installation operation can be smoothly carried out. And also because of the simple mechanism, its cost can be suppressed.

Moreover, the engaging pin 11 is constantly pushed toward the inner periphery surface of the spiral guide groove 15 of the spiral guide disk 13 by a spring force of the coil spring 12 installed inside a rear portion of the engaging pin 11. This can prevent a rattle or wobbly (or loose) engagement between these engaging pin 11 and spiral guide groove 15.

In this embodiment, since the second coil yoke 32 and the second electromagnetic coil 33 are installed in the dead space located at the inner circumferential side of the first coil yoke 19, upsizing of the whole size of the apparatus can be prevented. In addition, effective utilization of the dead space is made.

Further, the spiral guide disk 13 is ratatably supported by the first coil yoke 19 through the ball bearing 25. With this structure or arrangement, the spiral guide disk 13 can be prevented from shifting in the radial direction. That is, the spiral guide disk 13 can rotate smoothly without wobbling in the radial direction.

In this embodiment, in a case where the temperature of the oil that flows into the oil induction space 40 from the oil supply passage 35 is low temperature of, for example, 10° C. or less at the engine start-up, the thermostatic member 39 is approximately linear in form without curving. The valve body 38 is then put in a closing state in which the valve portion 38*a* of the valve body 38 closes the oil induction space 40, and the flow of the oil from the oil supply passage 35 toward the oil induction space 40 is limited here. Consequently, the oil flow into the space C is stopped, and the oil in the oil induction space 40 is discharged to an upper side of the cylinder head through the discharge passage 41. Here, although the oil is discharged from the discharge passage 41, since the cross-sectional area of the discharge passage 41 is smaller than that of the oil supply passage 35, an oil pressure equally acts on the each inner end surface. For this reason, the valve body 38 is unaffected by this oil pressure and does not move in the axial direction, namely that the valve body 38 remains in the closing state.

When the oil temperature of the oil induction space 40 rises under this state, the oil temperature is transferred or conveyed to the thermostatic member 39 from the flange portion 4*b* through the bolt 42. The thermostatic member 39 is then kept at the same temperature as the oil temperature. Thus this can suppress the variations of a working-start temperature of the oil flow quantity control valve 36.

When the oil temperature of the oil induction space 40 becomes a predetermined temperature or more, the top end portion side of the thermostatic member 39 slightly curves outward, and pulls out the stopper portion of the valve body 38. The valve body 38 is slightly pulled out toward the plate member 2*b* of the timing sprocket 2, and then the top end plane and the top end side of the inclined plane of the each control passage groove 38*b* of the valve portion 38*a* communicate with the space C. With this communication through a small opening area, some of the oil in the oil induction space 40 flow into the space C via the control passage grooves 38*b*, and some of the oil in the oil induction space 40 are discharged from the discharge passage 41.

When the oil temperature further rises, the thermostatic member 39 further curves outward with the temperature increase. The valve body 38 is also pulled out further, and the opening area communicating with the space C, of the valve hole 37 gradually becomes large, and the oil flow is gradually increased. Even when the valve body 38 starts to work, the oil flow into the space C is gradually increased. Thus, an occurrence of an undesirable braking force of the hysteresis ring 18 due to oil viscosity in the sliding motion is adequately prevented.

When the valve body 38 further protrudes (is further pulled out) with the temperature increase and the deformation of the thermostatic member 39, a protruding portion of the top end side of the valve body 38 touches one side of the plate member 2*b*, and the further movement of the valve body 38 is limited. In this state, the opening area of the valve hole 37 becomes maximum, and plenty of oil is supplied to an inside of the relative angular phase control mechanism 3 through the space C. The each part, such as hysteresis ring 18 and first electromagnetic coil 20, can be therefore effectively cooled and work smoothly.

Second Embodiment

Figure 8:
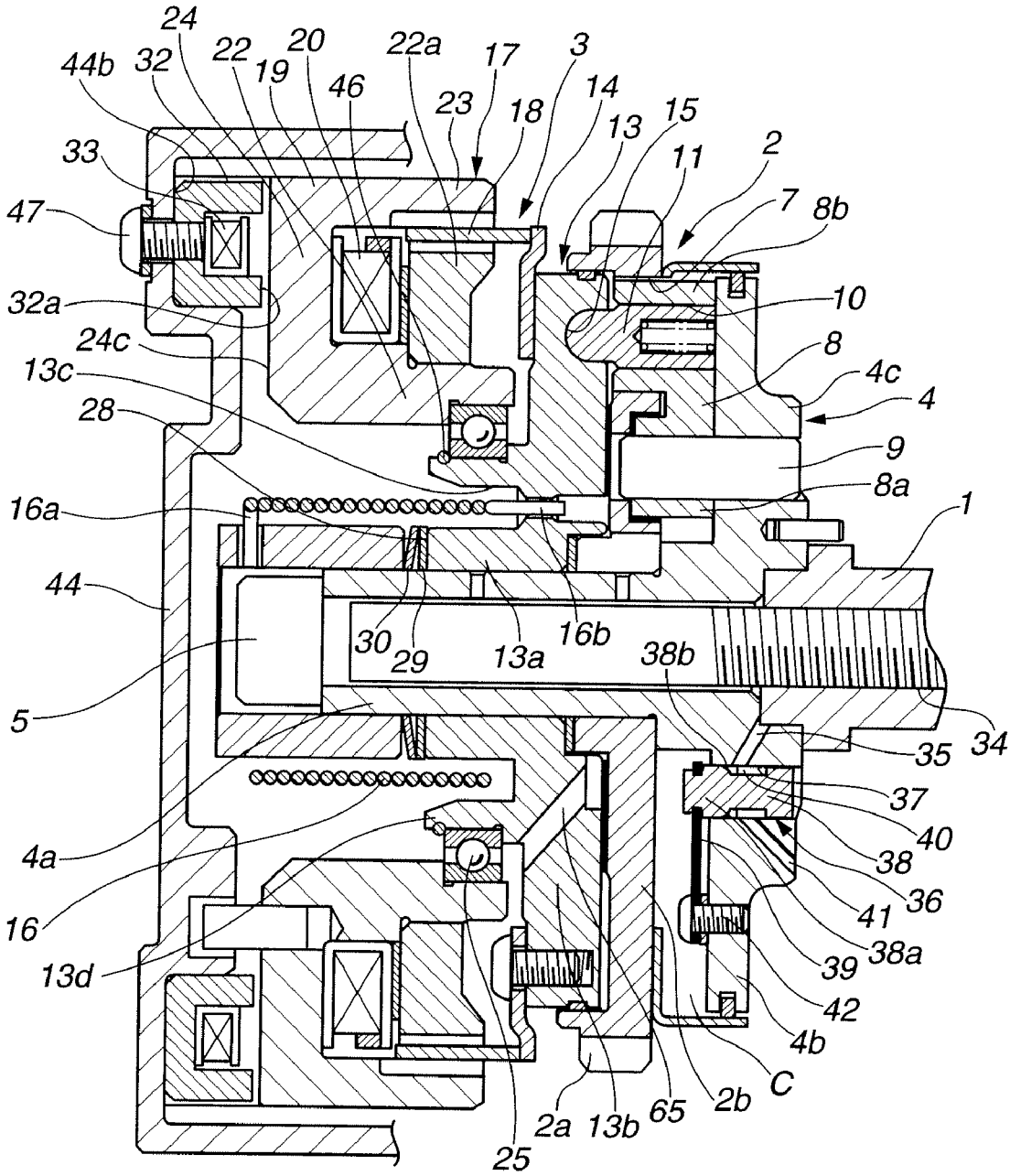
FIG. 8 is a longitudinal cross section of a variable valve timing control apparatus of an internal combustion engine, of a second embodiment.

The second embodiment is shown in FIG. 8. The structure and arrangement such as the arrangement of the disc spring 29 of the holding means, of the second embodiment are the same as the first embodiment. However, in the second embodiment, the electromagnet of the releasing means is installed to the VTC cover 44.

That is, the first coil yoke 19 and the first electromagnetic coil 20 of the hysteresis brake 17 are able to shift slightly in the axial direction together with the spiral guide disk 13 through the ball bearing 25.

Further, the second coil yoke 32 is substantially formed into a shape of a square bracket ([) in cross section. The second coil yoke 32 is fitted into a ring-shaped supporting groove 44*b* that is formed in an outer circumferential portion of the VTC cover 44, and fixed to the VTC cover 44 with a bolt 47. The second electromagnetic coil 33 is secured inside the second coil yoke 32. Further, as illustrated in FIG. 8, the second coil yoke 32 is arranged so that its rear end surface 32*a* faces a front end surface 24*c* of the annular yoke 24 of the first coil yoke 19 through an air gap. Structure except these structures is the same as the first embodiment.

In the second embodiment, when the second electromagnetic coil 33 is de-energized, the spiral guide disk 13 and also the hysteresis brake 17 are shifted toward the side of the engaging pin 11 (i.e. in the rear direction) by the spring force of the disc spring 29, and the spiral guide disk 13 is firmly pressed on the engaging pin 11 then is put in the holding state. On the other hand, when second electromagnetic coil 33 is energized, the second electromagnetic coil 33 (the second coil yoke 32) attracts the first coil yoke 19 (the hysteresis brake 17). At this time, the spiral guide disk 13 is also shifted in the front direction against the spring force of the disc spring 29, together with the first coil yoke 19, and holding state of the spiral guide disk 13 is released. Accordingly, the holding and releasing controls are performed in accordance with the engine operating condition, and the same effects as the first embodiment are obtained.

In the second embodiment, the the second coil yoke 32 and the second electromagnetic coil 33 are installed in a dead space that is located inside the VTC cover 44. Thus, effective utilization of the dead space is made. In addition, upsizing in the radial direction, of the apparatus can be prevented.

Third Embodiment

Figure 9:
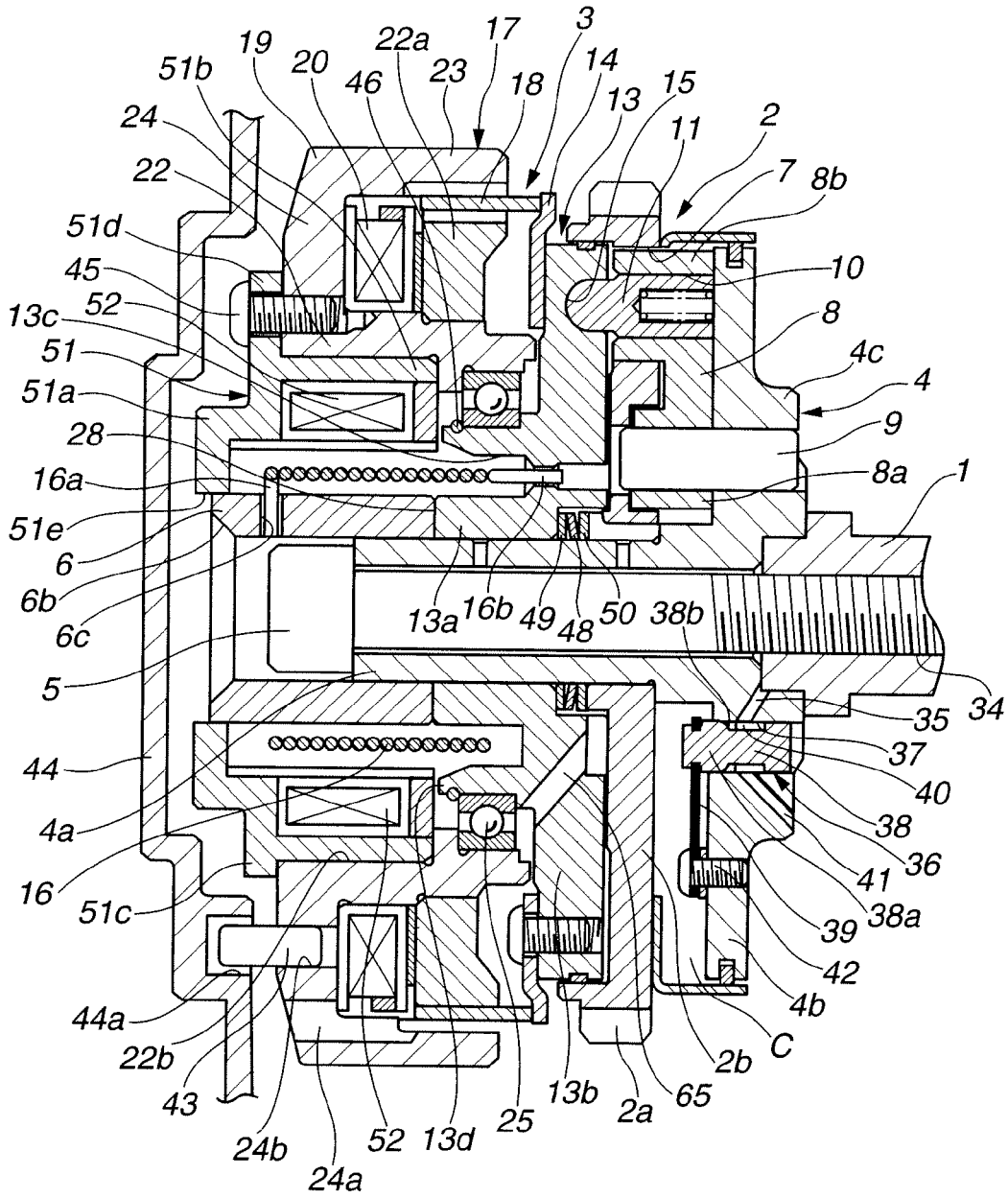
FIG. 9 is a longitudinal cross section of a variable valve timing control apparatus of an internal combustion engine, of a third embodiment.

The third embodiment is shown in FIG. 9. The holding means is formed by the electromagnet, and the releasing means is formed by the disc spring. In the third embodiment, the above mentioned ring shape groove 6*a*, formed on the outer periphery of the front end portion of the sleeve 6 in the first and second embodiments, is not provided.

Figure 10A:
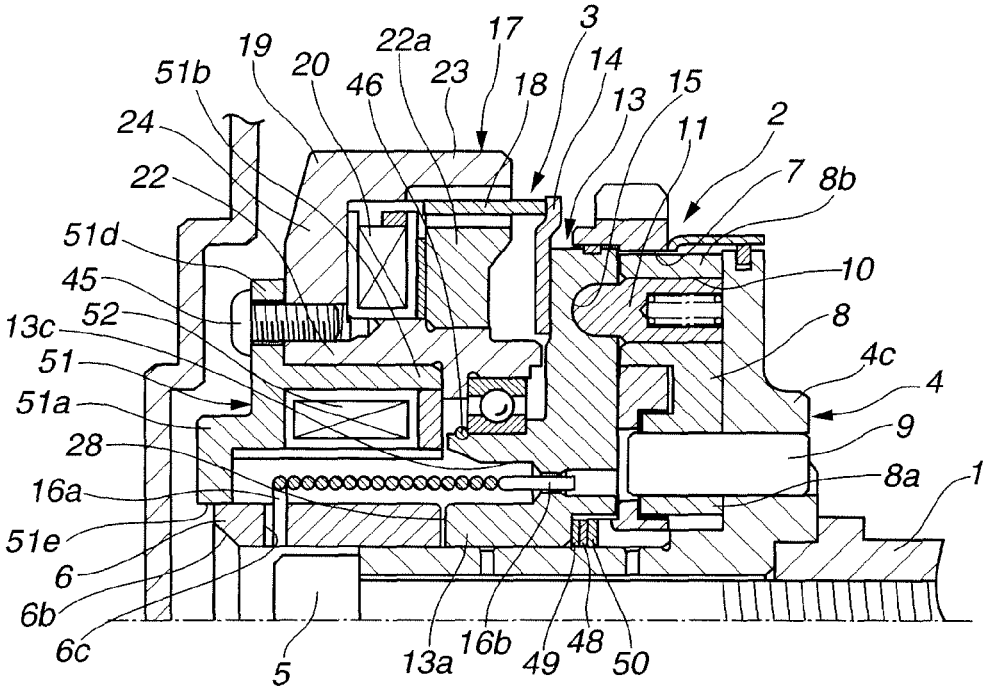
FIGS. 10A and 10B are drawings that explain actions according to the third embodiment.
Figure 10B:
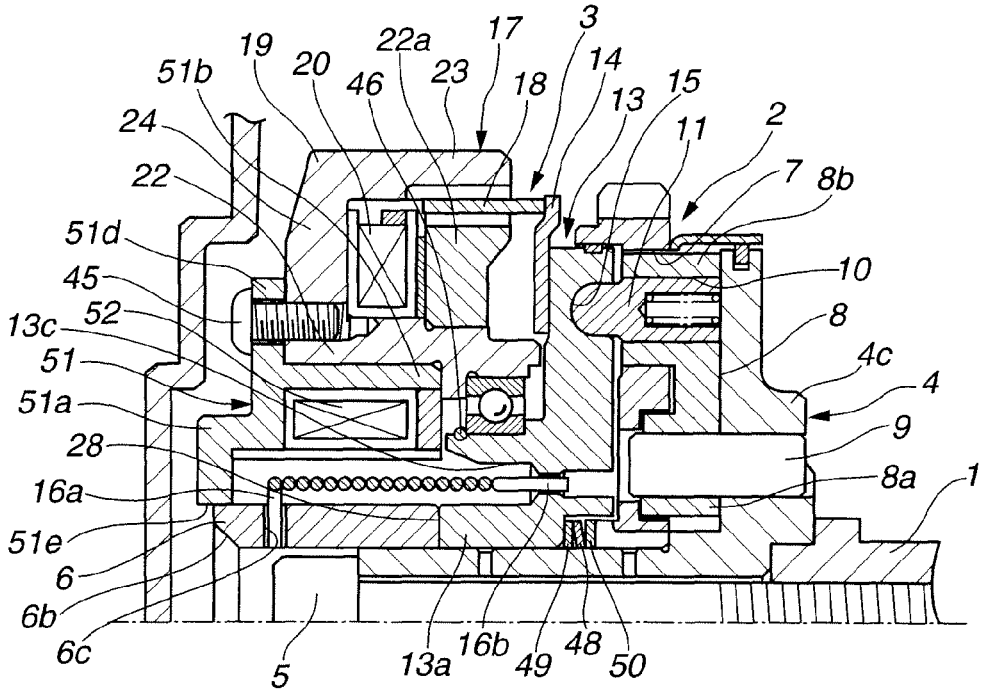

As shown in FIGS. 9, 10A and 10B, a disc spring 48 acting as the releasing means and a second coil yoke 51 and a second electromagnetic coil 52 acting as the holding means are provided. More specifically, the disc spring 48 is installed between a front end surface of the insertion hole 2*c* of the plate member 2*b* of the timing sprocket 2 and a bottom of a ring-shaped recessed portion that is formed inside the inner periphery portion 13*a* of the spiral guide disk 13 in the rear end of the inner periphery portion 13*a*. The disc spring 48 forces the spiral guide disk 13 in the direction that separates the spiral guide disk 13 from the engaging pin 11. That is, as shown in FIG. 10B, the disc spring 48 biases the spiral guide disk 13 toward the front direction (in the left direction in the drawing), namely in a releasing direction. The disc spring 48 is provided with ring-shaped retainers 49 and 50 to secure good sliding movement of the disc spring 48 and also the spiral guide disk 13 when the disc spring 48 is deformed.

As for the second coil yoke 51 and the second electromagnetic coil 52 forming the electromagnet and acting as the holding means, their structures are similar to those of the first embodiment. More specifically, the second coil yoke 51 has a front end side yoke 51*a*, a rear end side yoke 51*b* and protrusion 51*d* that is formed at an outer circumferential portion 51*c* of the front end side yoke 51*a*. Then, the second coil yoke 51 is fixed to the first coil yoke 19 through the protrusion 51*d* with the bolt 45. Further, as illustrated in FIG. 9, an inner circumferential surface 51*e* is formed on an inner circumferential portion of the front end side yoke 51*a*, and a rear end side of the inner circumferential surface 51*e* touches the outer circumferential surface of the sleeve 6.

The second electromagnetic coil 52 is supplied with the signal of energization (ON) or non-energization (OFF) by the controller via the harness. When supplied with ON signal, with the specific arrangement structure of the inner circumferential surface 51*e* of the front end side yoke 51*a* and the ring shape groove 6*a*, as shown in FIG. 10A, the second electromagnetic coil 52 moves or shifts the hysteresis brake 17 and the spiral guide disk 13 together with respect to the sleeve 6 toward the rear direction (in the right direction in the drawing, namely in the holding direction) by its electromagnetic force against a spring force of the disc spring 48.

Figure 11:
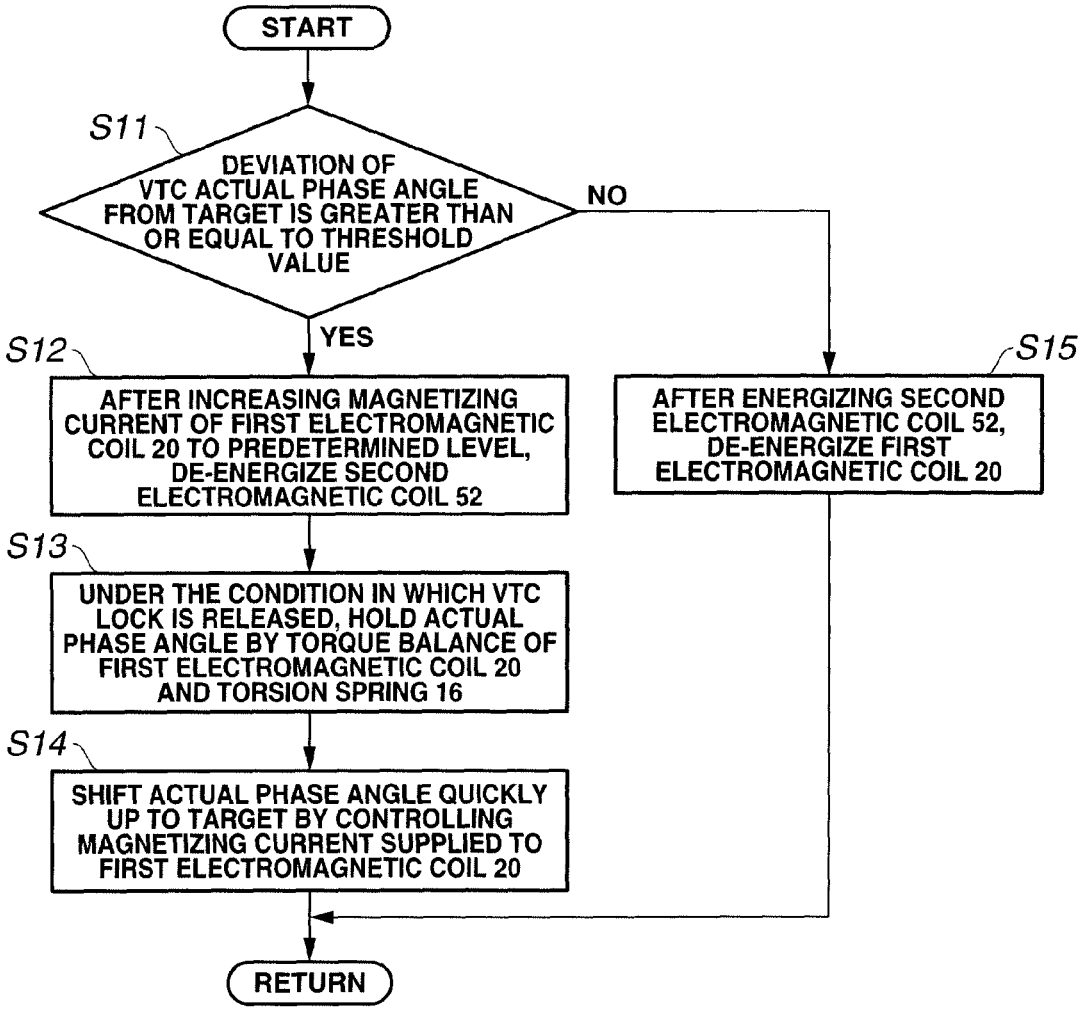
FIG. 11 is a control flow chart executed by a controller in the third embodiment.

In the following, a routine of a process in which the controller sends the ON/OFF signal to the second electromagnetic coil 52 will be explained with reference to a flow chart in FIG. 11. Here, this routine is performed, for example, at 10 ms cycle time.

At step S11, a judgment is made as to whether or not a deviation of an actual phase angle between a current crankshaft and camshaft, detected by the crank angle sensor and the cam angle sensor, from a preset target relative rotational phase angle is greater than or equal to a specified or certain value (a threshold value) under the normal driving condition after the engine start-up.

If the deviation is smaller than the threshold value, the routine proceeds to step S15. At step S15, since the actual phase angle is close to or equal to the target relative rotational phase angle, the controller sends the ON signal to the second electromagnetic coil 52 (the second electromagnetic coil 52 is energized), and thereafter sends the OFF signal to the first electromagnetic coil 20, then the routine returns to step S11. Thus the spiral guide disk 13 is pressed toward the side of the engaging pin 11 together with the hysteresis brake 17 by the electromagnetic force of the second electromagnetic coil 52, and the inner periphery surface of the spiral guide groove 15 is firmly pressed on the top end surface of the engaging pin 11, as shown in FIG. 10A. Thanks to this, since the timing sprocket 2 and the camshaft 1 are held and put in the locking state at a certain relative rotational angle, the operating force of the first electromagnetic coil 20 disappears, and the phase angle is maintained.

With regard to this locking state, it is a completely fixed state that is unaffected by all of the input, such as a restoring force of the torsion spring 16, the electromagnetic braking force produced by energizing the first electromagnetic coil 20, and a cam torque input to the camshaft 1 etc.

At step S11, if the deviation is greater than or equal to the threshold value (namely if YES), the routine proceeds to step S12. At step S12, the controller energizes the first electromagnetic coil 20 first, and raises its operating force. That is, the operating force, which relatively rotates the spiral guide disk 13 with respect to the timing sprocket 2 against the spring force of the torsion spring 16 by providing the electromagnetic braking force to the spiral guide disk 13 for changing the rotational phase of the driven rotary member 4, is increased in advance before rotating the spiral guide disk 13.

After that, the controller sends the OFF signal to the second electromagnetic coil 52, and as explained above and illustrated in FIG. 10B, shifts the spiral guide disk 13 and the hysteresis brake 17 to the front direction (in the left direction in the drawing) by the spring force of the disc spring 48. Then the firmly pressing force between the inner periphery surface of the spiral guide groove 15 and the top end surface of the engaging pin 11 is lowered and the holding force is released, namely that the locking state is released.

Subsequently, at step S13, under the condition in which the holding state of the spiral guide disk 13 is released, the actual phase angle is maintained at the certain middle position (between the current rotational position and the target rotational position) by balancing the electromagnetic braking force produced by energizing the first electromagnetic coil 20 with the spring force of the torsion spring 16.

At step S14, the actual phase angle is quickly shifted up to the target relative rotational phase angle by controlling the magnetizing current supplied to the first electromagnetic coil 20, then the routine returns to step S11.

As described above, with this process, it is possible to instantly or quickly convert the relative rotational phase angle between the timing sprocket 2 and the camshaft 1 in accordance with the change of the engine operating condition.

In addition, the other structure than the above mentioned structure of the third embodiment is the same as the first embodiment, thus the same effects as the first embodiment can be obtained.

Fourth Embodiment

Figure 12:
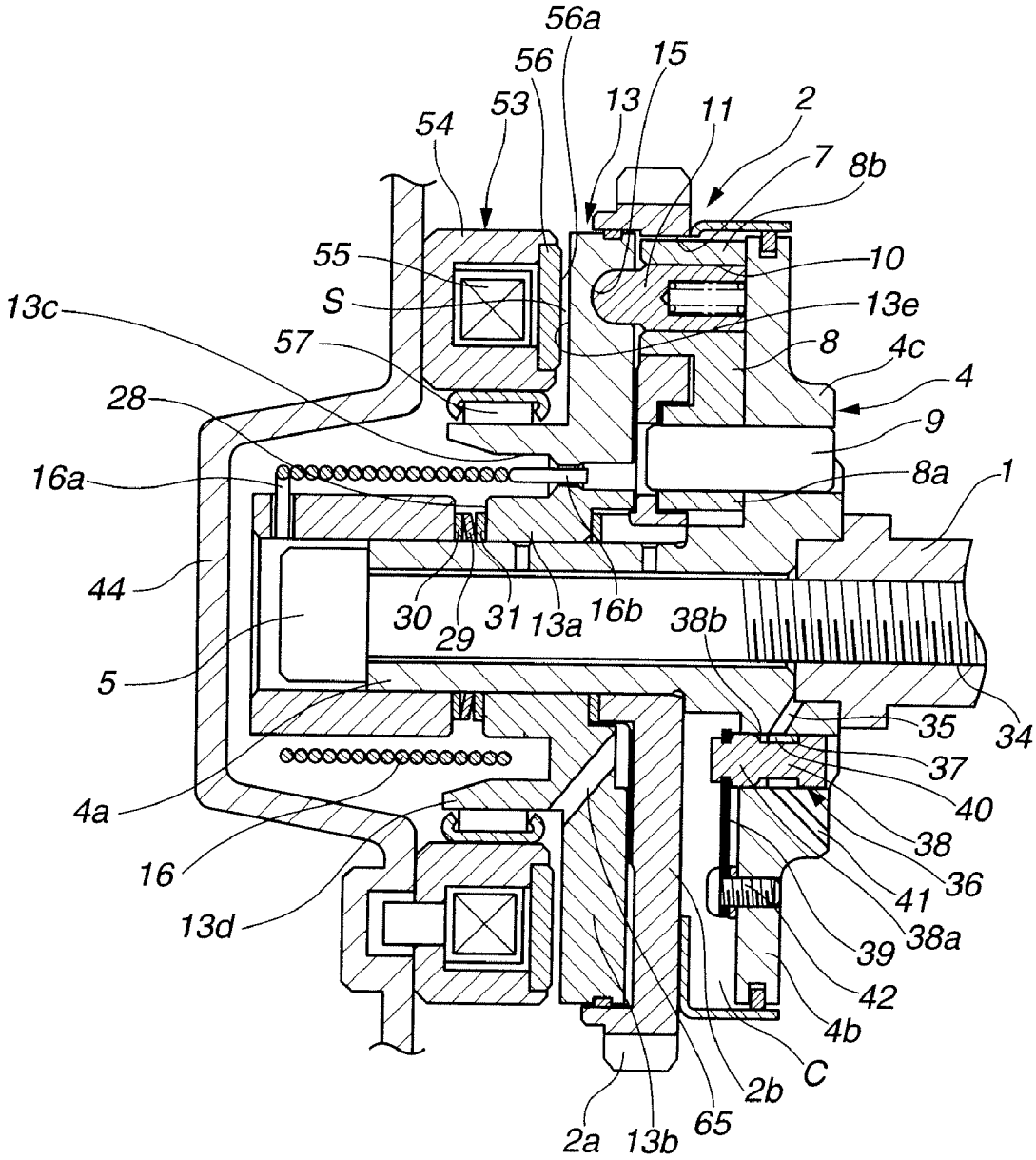
FIG. 12 is a longitudinal cross section of a variable valve timing control apparatus of an internal combustion engine, of a fourth embodiment.

The fourth embodiment is shown in FIG. 12. In this embodiment, for the rotational brake control of the spiral guide disk 13, a friction brake 53 is used instead of the hysteresis brake 17.

More specifically, the friction brake 53 is fixed to an inner surface of the VTC cover 44. The friction brake 53 has a coil yoke 54 that is substantially formed into a shape of a square bracket ([) in cross section, an electromagnetic coil 55 that is installed inside the coil yoke 54, and a ring shape friction member or pad or lining 56. This friction pad 56 is fixed to the coil yoke 54 so that the friction pad 56 closes a rear end opening of the coil yoke 54.

As illustrated in FIG. 12, a needle bearing 57 is provided between an inner circumferential surface of the coil yoke 54 and the spiral guide disk 13. The spiral guide disk 13 is then rotatably supported on the inner circumferential surface of the coil yoke 54 through the needle bearing 57. Further, the spiral guide disk 13 is allowed to move or shift slightly in the axial direction through the needle bearing 57.

The electromagnetic coil 55 is supplied with the control current of the signal of energization (ON) or non-energization (OFF) by the controller via the harness.

As for the friction pad 56, it is positioned so that its rear end surface 56*a* faces a front end surface 13*e* of the spiral guide disk 13 through a certain gap S. When energizing the electromagnetic coil 55, the spiral guide disk 13 is shifted toward the front direction (i.e. in the left direction) by way of the magnetic attraction generated by the energization of the electromagnetic coil 55. At this time, the front end surface 13*e* of the spiral guide disk 13 reaches and touches the rear end surface 56*a* of the friction pad 56, and then by this frictional resistance, the spiral guide disk 13 is provided with the braking force. That is, the rotation of the spiral guide disk 13 is stopped by the frictional resistance.

With regard to the gap S, it is set to such size that even if the oil (lubricating oil) flowing inside the VTC is present between the rear end surface 56*a* and the front end surface 13*e*, the spiral guide disk 13 is unaffected by oil viscosity of the lubricating oil. That is, the gap S is designed so that the spiral guide disk 13 is not dragged by a rotational driving force resulting from the oil viscosity of the lubricating oil.

The spiral guide disk 13 is permanently forced in the rotational direction of the timing sprocket 2 by the spring force of the torsion spring 16 in the same manner as the each embodiment.

Further, same as the first embodiment, the disc spring 29 is provided between the sleeve 6 and the inner periphery portion 13*a* of the spiral guide disk 13, and also the retainers 30 and 31 are provided at both sides of the disc spring 29 to secure the good sliding movement. The disc spring 29 forces the spiral guide disk 13 toward the engaging pin 11, and the holding state of the spiral guide disk 13 is maintained.

The other structure and arrangement are almost same as those of the first embodiment.

Figure 13A:
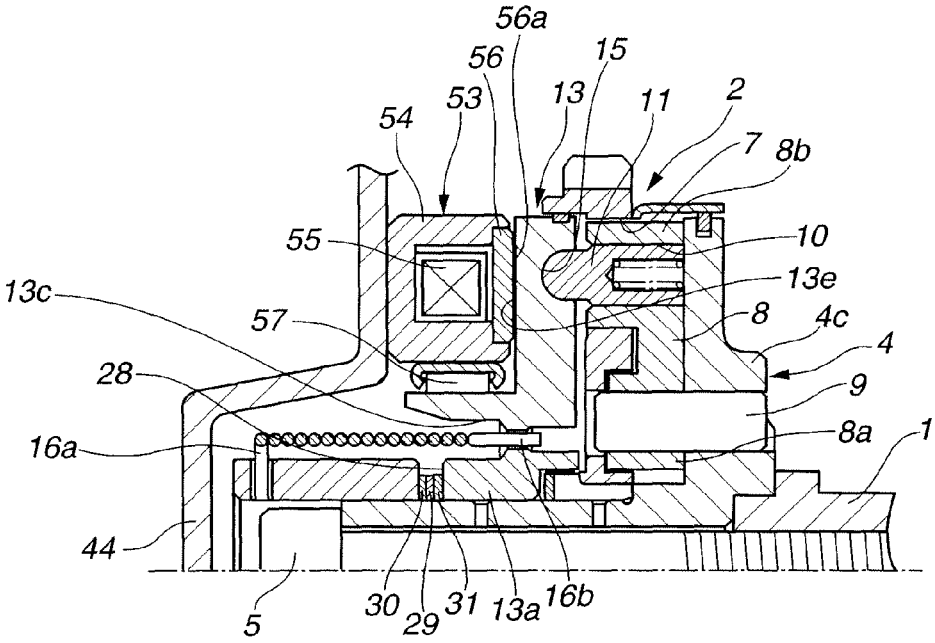
FIGS. 13A and 13B are drawings that explain actions according to the third embodiment.

In this embodiment, when applying the brake (the braking force) to the spiral guide disk 13 (when holding the spiral guide disk 13 at a certain rotational position) in accordance with the change of the engine operating condition, the controller outputs the ON signal to the electromagnetic coil 55, and the spiral guide disk 13 is electromagnetically attracted by the electromagnetic coil 55. As a result, as shown in FIG. 13A, the spiral guide disk 13 is shifted in the left direction in the drawing against the spring force of the disc spring 29, and the front end surface 13*e* touches the rear end surface 56*a* of the friction pad 56.

With this contact between these front end surface 13*e* and rear end surface 56*a*, the frictional resistance is generated between them. The free rotation of the spiral guide disk 13 is therefore restrained, and the spiral guide disk 13 is maintained at the certain rotational position.

Figure 13B:
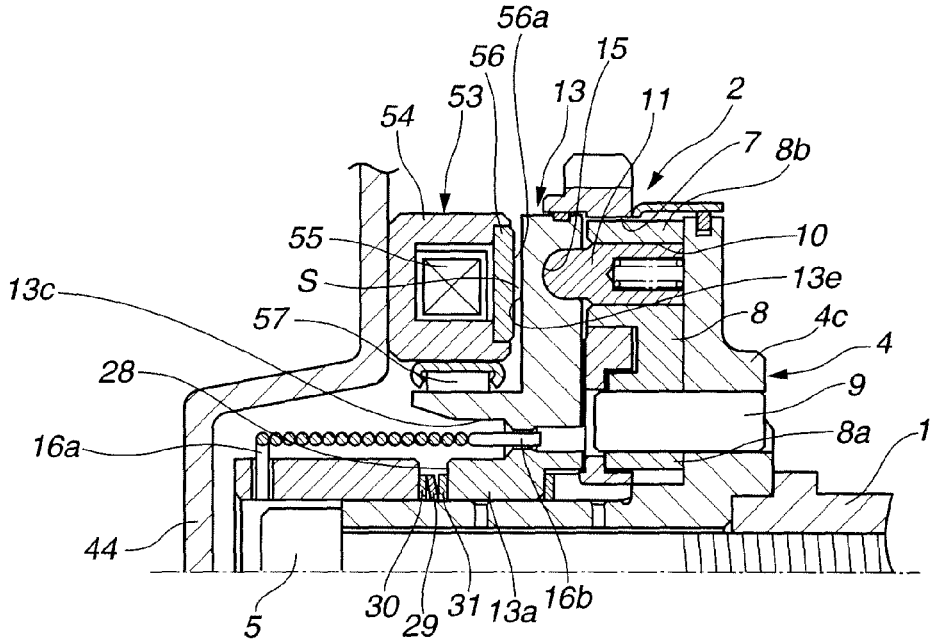

On the other hand, when releasing the brake (the braking force) of the spiral guide disk 13 (when releasing the holding state of the spiral guide disk 13), the controller outputs the OFF signal to the electromagnetic coil 55. Since the magnetic attraction by the electromagnetic coil 55 disappears, the spiral guide disk 13 is forced toward the engaging pin 11 by the spring force of the disc spring 29, and as shown in FIG. 13B, the spiral guide disk 13 shifts in the right direction and separates from the friction pad 56. With this separation, the holding state of the spiral guide disk 13 is released.

As described above, in this embodiment, the rotational brake control of the spiral guide disk 13 is carried out using the friction pad 56, then the spiral guide disk 13 is maintained at the certain rotational position. Further, the holding state of the spiral guide disk 13 at the certain rotational position is released by the disc spring 29. On the other hand, the spiral guide disk 13 is firmly pressed on the top end surface of the engaging pin 11 by this disc spring 29. Therefore, the same effects as the above explained embodiments can be obtained. In addition, the whole structure of the apparatus can be not only simplified, but the length in the axial direction can be shortened as well.

In the present invention, the structure or arrangement of the each embodiment is not limited. For instance, as the metal spring, the wave spring or the coil spring could be used except for the disc spring. Or synthetic resin having an elastic force might be used. Furthermore, as the thermostatic member 39, a shape memory alloy or a wax pellet could be used except for the bimetal.

This application is based on a prior Japanese Patent Application No. 2007-261582 filed on Oct. 5, 2007. The entire contents of this Japanese Patent Application No. 2007-261582 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member rotated by an engine crankshaft;

a driven rotary member fixedly connected to a camshaft and transferring a turning force from the drive rotary member to the camshaft;

a phase-change mechanism changing a relative rotational phase between the drive and driven rotary members, the phase-change mechanism including:

an intermediate rotary member installed between the drive and driven rotary members for a relative rotational phase control and having a guide;

a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a holding mechanism which forces the intermediate rotary member and holds the relative rotational phase between the drive and driven rotary members at a predetermined relative rotational phase position; and a releasing mechanism which releases a holding state of the holding mechanism.

2. The variable valve timing control apparatus as claimed in claim 1, wherein:

the holding mechanism has a metal spring.

3. The variable valve timing control apparatus as claimed in claim 2, wherein:

the releasing mechanism has an electromagnetic coil and a coil yoke that surrounds the electromagnetic coil, and is configured to attract the intermediate rotary member by an electromagnetic attraction generated by energizing the electromagnetic coil.

4. The variable valve timing control apparatus as claimed in claim 3, wherein:

the operating force application mechanism has an electromagnetic unit that produces the operating force by being energized, and the intermediate rotary member is rotatably supported by the electromagnetic unit through a bearing.

5. The variable valve timing control apparatus as claimed in claim 4, wherein:

the electromagnetic unit is an electromagnetic braking mechanism that controls a rotational position of the intermediate rotary member by applying a braking force to the intermediate rotary member.

6. The variable valve timing control apparatus as claimed in claim 5, wherein:

the operating force application mechanism has a biasing unit that forces the intermediate rotary member in a rotational direction, and when the braking force is applied to the intermediate rotary member by the electromagnetic braking mechanism, the intermediate rotary member is relatively rotated with respect to the drive rotary member against a biasing force of the biasing unit.

7. The variable valve timing control apparatus as claimed in claim 6, wherein:

the releasing mechanism is configured to shift the intermediate rotary member in an axial direction by attracting the electromagnetic braking mechanism.

8. The variable valve timing control apparatus as claimed in claim 7, wherein:

the releasing mechanism is installed in a dead space that is located at either or both of inner and outer circumferential sides of the electromagnetic braking mechanism.

9. The variable valve timing control apparatus as claimed in claim 1, wherein:

when a deviation of an actual relative rotational phase angle between the drive and driven rotary members from a target relative rotational phase angle that is set according to an engine operating condition is greater than or equal to a specified value, the relative rotational phase control is performed as follows;

(a) increasing the operating force of the operating force application mechanism to a predetermined level, (b) releasing the holding state of the intermediate rotary member by the releasing mechanism, (c) maintaining the actual relative rotational phase angle at a certain middle position by torque balance between the operating force and a biasing force that forces the intermediate rotary member in a rotational direction, and (d) shifting the actual relative rotational phase angle up to the target relative rotational phase angle by controlling the operating force.

10. The variable valve timing control apparatus as claimed in claim 9, wherein:

the shifting control of the actual relative rotational phase angle, of the case where the deviation is greater than or equal to the specified value is performed at a time of an engine stop.

11. A variable valve timing control apparatus of an internal combustion engine, comprising:

a drive rotary member rotated by an engine crankshaft;

a driven rotary member fixedly connected to a camshaft and transferring a turning force from the drive rotary member to the camshaft;

a phase-change mechanism changing a relative rotational phase between the drive and driven rotary members, the phase-change mechanism including:

an intermediate rotary member installed between the drive and driven rotary members for a relative rotational phase control and having a guide;

a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a relative rotational position between the intermediate rotary member and the driven rotary member being held by shifting the intermediate rotary member in one axial direction, and a holding state of the relative rotational position being released by shifting the intermediate rotary member in the other axial direction.

12. The variable valve timing control apparatus as claimed in claim 11, wherein:

the intermediate rotary member is forced in the one axial direction by a spring force of a spring member, and the relative rotational position between the intermediate rotary member and the driven rotary member is held by the spring force.

13. The variable valve timing control apparatus as claimed in claim 12, wherein:

the intermediate rotary member is attracted in the other axial direction by an electromagnetic force, and the holding state of the relative rotational position is released by the electromagnetic force.

14. The variable valve timing control apparatus as claimed in claim 13, wherein:

the spring member provides a frictional resistance between the guide of the intermediate rotary member and the engaging member by the spring force, and holds the relative rotational position between the intermediate rotary member and the driven rotary member.

15. The variable valve timing control apparatus as claimed in claim 14, wherein:

in the condition in which the relative rotational position between the intermediate rotary member and the driven rotary member is held by the spring force of the spring member or the electromagnetic force, the engaging member is supported between the driven rotary member and the guide of the intermediate rotary member.

16. The variable valve timing control apparatus as claimed in claim 15, wherein:

the engaging member is forced toward the intermediate rotary member by a biasing member.

17. The variable valve timing control apparatus as claimed in claim 11, wherein:

the relative rotational position between the intermediate rotary member and the driven rotary member is held by an electromagnetic force.

18. The variable valve timing control apparatus as claimed in claim 17, wherein:

the holding state of the relative rotational position is released by a spring force of a spring member by controlling the electromagnetic force to be decreased.

19. The variable valve timing control apparatus as claimed in claim 18, wherein:

the electromagnetic force provides a frictional resistance between the guide of the intermediate rotary member and the engaging member, and holds the relative rotational position between the intermediate rotary member and the driven rotary member.

20. The variable valve timing control apparatus as claimed in claim 18, wherein:

the operating force application mechanism has an electromagnetic braking mechanism configured so that the intermediate rotary member is relatively rotated with respect to the drive and driven rotary members by being shifted by an electromagnetic attraction against the spring force of the spring member and touching a friction member, and the intermediate rotary member is designed so that the intermediate rotary member is spaced apart from the friction member at a predetermined gap by the spring force of the spring member when the intermediate rotary member is provided with no electromagnetic attraction.

21. The variable valve timing control apparatus as claimed in claim 20, wherein:

the gap between the intermediate rotary member and the friction member when the intermediate rotary member is provided with no electromagnetic attraction, is set to such size that even if lubricating oil is present between the intermediate rotary member and the friction member during an engine start-up at low engine temperature, the intermediate rotary member is unaffected by a rotational driving force resulting from oil viscosity of the lubricating oil.

22. The variable valve timing control apparatus as claimed in claim 20, wherein:

the gap between the intermediate rotary member and the friction member when the intermediate rotary member is provided with no electromagnetic attraction, is set to such size that even if lubricating oil is present between the intermediate rotary member and the friction member, the intermediate rotary member is unaffected by a rotational driving force resulting from oil viscosity of the lubricating oil.

23. A variable valve timing control apparatus of an internal combustion engine, comprising:

a drive rotary member rotated by an engine crankshaft;

a driven rotary member fixedly connected to a camshaft and transferring a turning force from the drive rotary member to the camshaft;

a phase-change mechanism changing a relative rotational phase between the drive and driven rotary members, the phase-change mechanism including:

an intermediate rotary member installed between the drive and driven rotary members for a relative rotational phase control and having a guide;

a link member linking the intermediate rotary member and the driven rotary member and having an engaging member that is engaged in and guided by the guide, the link member shifting a rotation of the driven rotary member by a rotation of the intermediate rotary member through the guided engaging member; and an operating force application mechanism applying an operating force to the intermediate rotary member to relatively rotate the intermediate rotary member with respect to the drive and driven rotary members, and a holding mechanism which provides the intermediate rotary member with a frictional resistance and holds the relative rotational phase between the drive and driven rotary members at a predetermined relative rotational phase position; and a releasing mechanism which releases the holding mechanism according to an energizing condition of an electromagnetic coil.

24. The variable valve timing control apparatus as claimed in claim 23, wherein:

The releasing mechanism is controlled by two conditions of energization and de-energization of the electromagnetic coil.

* * * * *